US008399168B2

(12) United States Patent
Kamoto

(10) Patent No.: US 8,399,168 B2
(45) Date of Patent: Mar. 19, 2013

(54) METHOD FOR PRODUCING TONER, TWO-COMPONENT DEVELOPER, DEVELOPING DEVICE AND IMAGE FORMING APPARATUS

(75) Inventor: Takanori Kamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 664 days.

(21) Appl. No.: 12/549,498

(22) Filed: Aug. 28, 2009

(65) Prior Publication Data

US 2010/0055597 A1 Mar. 4, 2010

(30) Foreign Application Priority Data

Aug. 29, 2008 (JP) ..... P2008-222843

(51) Int. Cl.
*G03G 9/087* (2006.01)

(52) U.S. Cl. ..... 430/109.4

(58) Field of Classification Search ..... 430/109.4
See application file for complete search history.

(56) References Cited

U.S. PATENT DOCUMENTS

| | | | |
|---|---|---|---|
| 2001/0046636 | A1 | 11/2001 | Daimon et al. |
| 2006/0051693 | A1 | 3/2006 | Sata et al. |
| 2006/0057483 | A1 | 3/2006 | Yanase et al. |
| 2006/0216623 | A1 | 9/2006 | Matsumura et al. |
| 2008/0025754 | A1 | 1/2008 | Ishiyama et al. |

FOREIGN PATENT DOCUMENTS

| | | |
|---|---|---|
| CN | 1749867 A | 3/2006 |
| JP | 2001-305796 | 11/2001 |
| JP | 2005-128176 | 5/2005 |
| JP | 2005-338339 | 12/2005 |
| JP | 2006-84843 | 3/2006 |
| JP | 2006-106679 | 4/2006 |
| JP | 2006-265416 | 10/2006 |
| JP | 2007-248666 | 9/2007 |
| JP | 2008-33057 | 2/2008 |
| JP | 2008-298993 | 12/2008 |

*Primary Examiner* — Mark F Huff
*Assistant Examiner* — Rachel Zhang
(74) *Attorney, Agent, or Firm* — Nixon & Vanderhye PC

(57) ABSTRACT

A method for producing a toner, that can produce a low temperature fixable toner in a stable manner, a toner produced by the production method, a two-component developer using the toner, a developing device and an image forming apparatus are provided. The toner is produced using an aqueous dispersion obtained by dispersing a crystalline self-dispersion polyester resin having at least one carboxyl group and containing a compound represented by the following chemical formula (1) as an alcohol component in an aqueous medium. The aqueous dispersion, a colorant particle aqueous dispersion and a wax particle aqueous dispersion are mixed to aggregate, and a non-crystalline self-dispersion polyester resin particle aqueous dispersion is further added to perform aggregation. The liquid mixture containing the aggregates is heated and washed, thereby obtaining a toner:

$$H\text{-}(O\text{—}CH_2CH_2CH_2CH_2)_n\text{-}OH \quad (1)$$

wherein n is an integer of from 2 to 50.

8 Claims, 3 Drawing Sheets

METHOD FOR PRODUCING TONER, TWO-COMPONENT DEVELOPER, DEVELOPING DEVICE AND IMAGE FORMING APPARATUS

CROSS-REFERENCE TO RELATED APPLICATION

This application claims priority to Japanese Patent Application No. 2008-222843, which was filed on Aug. 29, 2008, the contents of which are incorporated herein by reference in their entirety.

BACKGROUND OF THE INVENTION

1. Field of the Invention

The present invention relates to a method for producing a toner, a toner, a two-component developer, a developing apparatus and an image forming apparatus.

2. Description of the Related Art

Office automation equipments have been remarkably developed in these days and in line with such development, there has been a wide spread of copiers, printers, facsimile machines, and the like machines which form images through the electrophotographic system. In general, an image is formed by way of a charging step, an exposing step, a developing step, a transferring step, a cleaning step, and a fixing step in an image forming apparatus which employs the electrophotographic system.

At the charging step, a surface of a photoreceptor serving as an image bearing member is evenly charged in a dark place. At the exposing step, the charged photoreceptor receives signal light derived from a document image, resulting in removal, of charges on the exposed part of the photoreceptor whose surface thus bears an electrostatic charge image (an electrostatic latent image). At the developing step, a toner is supplied to the electrostatic charge image on the surface of the photoreceptor, thereby forming a toner image (a visualized image). At the transferring step, a recording medium such as paper or sheet is brought into contact with the toner image on the surface of the photoreceptor, and the corona discharge is then generated toward the recording medium from one side thereof which is reverse to the side in contact with the toner image, to thereby provide the recording medium with charges of which polarity is opposite to that of charges of the toner, thus transferring the toner image onto the recording medium. At the fixing step, the toner image on the recording medium is fixed by means of heat, pressure and so on. At the cleaning step, the toner is collected which has not been transferred onto the recording medium and thus remains on the surface of the photoreceptor. Through the above steps, a desired image is formed by the image forming apparatus employing the electrophotographic system.

In recent years, with trend of speed-up of process and energy saving, it is desired that a toner used in an electrophotographic image forming apparatus can be fixed at low temperature. A method for adding crystalline polyester having low melting point is proposed as a method for producing a low-temperature fixable toner. The production method includes a dry process and a wet process. Particularly, a method for producing a toner by a wet process is energetically investigated. For example, seven production methods described in Japanese Unexamined Patent Publications JP-A 2001-305796, JP-A 2006-84843, JP-A 2007-248666, JP-A 2006-106679, JP-A 2006-265416, JP-A 2008-33057 and JP-A 2005-128176 are known.

A method for producing a toner having low melting point using crystalline polyester by a wet process leads to the problem that the crystalline polyester does not stably disperse in water, and elimination of the problem becomes the issue. The methods for producing a toner described in JP-A 2001-305796, JP-A 2006-84843, JP-A 2007-248666, JP-A 2006-106679, JP-A 2006-265416, JP-A 2008-33057 and JP-A 2005-128176 attend to overcome the issue by the respective different methods.

In the method described in JP-A 2001-305796, it is essential to use crystalline polyester containing a sulfo group having high dispersion stability, and in emulsifying, the crystalline polyester is dispersed in water using a surfactant. In the method described in JP-A 2006-84843, it is essential to use crystalline polyester containing a sulfo group, and the crystalline polyester is melted and forcibly emulsified in water. In the method described in JP-A 2007-248666, it is essential to use crystalline polyester containing a sulfo group. The crystalline polyester is dissolved in an organic solvent, and the resulting solution is mixed with water while applying shear force, thereby emulsifying the crystalline polyester.

The methods described in JP-A 2001-305796, JP-A 2006-84843 and JP-A 2007-248666 attend to stabilization of dispersion by using crystalline polyester containing a sulfo group. However, when a sulfo group is contained in a toner in large amount, the problem occurs that environmental dependency of charging characteristics is increased, that is, environmental characteristics are deteriorated. Therefore, the amount of the crystalline polyester used in a toner is limited. A method of conducting encapsulation with non-crystalline polyester or the like, without deteriorating environmental characteristics while enhancing dispersion stability is exemplified to overcome the problem. However, even though encapsulation is conducted, it is extremely difficult on production method to completely cover the crystalline polyester, and the essential problem of deterioration of environmental characteristics is not overcome.

The method described in JP-A 2006-106679 conducts emulsification by using a surfactant. The method described in JP-A 2006-265416 conducts emulsification by preparing crystalline polyester from a monomer dispersed in water by emulsion polymerization. Both methods do not essentially require to use crystalline polyester containing a sulfo group, but are essential to use a surfactant. Therefore, when a toner is produced, the surfactant is introduced into the toner, and this leads to the problem that environmental characteristics of the toner produced are deteriorated. Additionally, it is extremely difficult to remove the surfactant introduced into the toner produced.

The method described in JP-A 2008-33057 conducts phase inversion emulsification by mixing crystalline polyester and non-crystalline polyester and dissolving the resulting mixture in an organic solvent. This method increases dispersion stability by mixing the two polyesters and dissolving the mixture in an organic solvent. However, crystalline polyester particles and non-crystalline polyester particles are dispersed in an entangled state after phase inversion emulsification, and the inherent crystallizability of the crystalline polyester is not achieved.

In the method described in JP-A 2005-128176, crystalline polyester is heat melted and dispersed in an alkaline solution. This method does not require crystalline polyester containing a functional group which deteriorates environmental characteristics, and conducts emulsification without using a surfactant. However, the heat melting does not sufficiently resolve entanglement, of crystalline polyester particles with each other, and dispersion particle size is increased. As a result, dispersion stability may be decreased and particle size of a toner produced may be increased. Furthermore, condensation of crystalline polyester is induced, and molecular weight of polyester particle may be increased. Additionally, in the method of dispersion by heat melting, particle size distribution of dispersed particles becomes wide, and scattering causes in size of the toner produced. As a result, sufficiently high definition image cannot be formed.

Thus, attempts to overcome the problem in dispersibility in the method for producing a toner using crystalline polyester have been made, however, in the conventional methods, other problems are involved with resolution of the problem, and it can be hardly said that the problem is sufficiently solved.

SUMMARY OF THE INVENTION

An Object of the invention is to provide a method for producing a toner that can stably produce a low temperature fixable toner containing crystalline polyester, a toner, a two-component developer, a developing device, and an image forming apparatus.

The invention provides a method for producing a toner, comprising:

a liquid mixture preparation step of mixing at least a colorant particle aqueous dispersion containing colorant particles, a wax particle aqueous dispersion containing wax particles and a crystalline self-dispersion polyester resin particle aqueous dispersion containing at least one carboxyl group as a hydrophilic group, thereby preparing a liquid mixture;

an aggregate formation step of adding a polyvalent metal salt as an aggregating agent to the liquid mixture obtained above, aggregating the colorant particles, the wax particles and the crystalline self-dispersion polyester resin particles to form aggregates, and mixing a non-crystalline polyester resin particle aqueous dispersion with the liquid mixture containing the aggregates to further perform aggregation; and a particle formation step of heating the liquid mixture after completion of the aggregate formation step to uniformize particle size and shape of the aggregates in the liquid mixture, wherein the crystalline self-dispersion polyester resin particles contain a compound represented by the following chemical formula (1) as an alcohol component:

$$H\text{-}(O\text{—}CH_2CH_2CH_2CH_2)_n\text{-}OH \quad (1)$$

wherein n is an integer of from 2 to 50.

According to the invention, there is provided a method for producing a toner comprises a liquid mixture preparation step of mixing at least a colorant particle aqueous dispersion containing colorant particles, a wax particle aqueous dispersion containing wax particles and a crystalline polyester resin particle aqueous dispersion containing crystalline self-dispersion polyester resin particles having at least one carboxyl group as a hydrophilic group, thereby preparing a liquid mixture; an aggregate formation step of adding a polyvalent metal salt as an aggregating agent to the liquid mixture, aggregating the colorant particles, the wax particles and the crystalline self-dispersion polyester resin particles to form aggregates, and mixing a non-crystalline polyester resin particle aqueous dispersion with the liquid mixture containing the aggregates to further perform aggregation; and a particle formation step of heating the liquid mixture after completion of the aggregate formation step to uniformize particle size and shape of the aggregates in the liquid mixture, wherein the crystalline self-dispersion polyester resin particles contain a compound represented by the chemical formula (1) as an alcohol compound. Thus, because the crystalline self-dispersion polyester resin contains a compound represented by the chemical formula (1) as an alcohol component, the resin can stably be dispersed in water. Therefore, according to the production method using the resin particles, a toner can be produced in a stable manner. The resin particles can reduce the content of a functional group deteriorating environmental characteristics by containing a carboxyl group therein. Therefore, according to the production method using the resin particle aqueous dispersion, a toner having good environmental characteristics can be produced.

In the invention, it is preferable that the crystalline self-dispersion polyester resin contains 1,4-butanediol as an alcohol component.

According to the invention, the crystalline self-dispersion polyester resin contains 1,4-butanediol as an alcohol component. Thus, because the crystalline self-dispersion polyester resin contains 1,4-butanediol as an alcohol component, a toner having high crystallizability and low viscosity when softened can be produced according to the production method using the crystalline self-dispersion polyester resin particles. Furthermore, the resin particles are stably dispersed in water by containing 1,4-butanediol as an alcohol component therein. Therefore, according to the production method using an aqueous dispersion of the resin particles, a toner can be produced in a stable manner.

Further, in the invention, it is preferable that the crystalline polyester resin particle aqueous dispersion is prepared by phase inversion emulsification changing phase into an aqueous system after conducting swelling or dissolution with an organic solvent, without using a surfactant.

According to the invention, the crystalline self-dispersion polyester resin particle aqueous dispersion is prepared by phase inversion emulsification changing phase into an aqueous system after conducting swelling or dissolution with an organic solvent, without using a surfactant. Because the preparation disperses the crystalline self-dispersion polyester resin particles by phase inversion emulsification, a crystalline self-dispersion polyester resin particle aqueous dispersion having high crystallizability and dispersion stability can be obtained without broadening a particle size distribution of dispersed particles in the aqueous dispersion, without increasing an average particle size and without causing change in molecular weight of the crystalline self-dispersion polyester resin. The preparation does not use a surfactant. Therefore, according to the production method using the aqueous dispersion, a toner having good environmental characteristics can be produced.

Further, in the invention, it is preferable that the non-crystalline self-dispersion polyester resin particles contain a carboxyl group as a hydrophilic group.

According to the invention, the non-crystalline self-dispersion polyester resin particles contain a carboxyl group as a hydrophilic group. The resin particles can reduce the content of a functional group deteriorating environmental characteristics by containing a carboxyl group therein. Therefore, according to the production method using aqueous dispersion of the resin particles, a toner having good environmental characteristics can be produced.

Further, in the invention, it is preferable that the crystalline self-dispersion polyester resin particles have a volume average particle size of 0.3 μm or less.

According to the invention, the crystalline self-dispersion polyester resin particles have a volume average particle size of 0.3 μm or less. The aggregates are easily controlled to have a desired size by controlling the volume average particle size of the resin particles to 0.3 μm or less. Therefore, according to the production method using the aqueous dispersion containing the resin particles, a toner having small scattering in particle size and small volume average particle size can be produced.

Further, the invention provides a toner comprising toner particles made of particulate aggregates produced by the method for producing a toner mentioned above.

According to the invention, a toner comprises particles made of particulate aggregates produced by the production method. The toner obtained by the production, method has low softening point, and can therefore be fixed at low temperature. Furthermore, the toner has good environmental characteristics, and can therefore stably form an image even though the environment is changed.

Further, in the invention, it is preferable that a colorant component and a crystalline polyester resin component are present in a surface layer in small amount and is present in the inside in large amount.

According to the invention, the toner is that at least one of the colorant component and the crystalline self-dispersion polyester resin component is present in a vicinity of the surface thereof in small amount, and is present in the inside thereof in large amount. The toner is that the colorant component is present in the inside thereof in larger amount than the vicinity of the surface thereof. This constitution can reduce difference in charge amount between toners containing different colorants. Furthermore, the crystalline self-dispersion polyester resin component is present in the inside in larger amount as compared with the vicinity of the surface. Therefore, storage stability of the toner can be increased.

Further, in the invention, it is preferable that one or more of inorganic particles having an average particle size of 0.2 μm or less is externally added to the surface of toner particles.

According to the invention, one or more of inorganic particles having an average particle size of 0.2 μm or less is externally added to the surface of toner particles. Because one or more of inorganic particles having an average particle size of 0.2 μm or less is externally added to the surface, the toner has improved fluidity and can stably be used over a long period of time.

Further, the invention provides a two-component developer comprising the toner mentioned above and a carrier.

According to the invention, a two-component developer comprising the toner and a carrier is provided. The two-component developer can perform low temperature fixation due to use of the toner having excellent low temperature fixability and good environmental characteristics, can respond to high speed process, and can stably form an image even though the environment is changed.

Further, the invention provides a developing device which performs development using a developer containing the toner, or the two-component developer mentioned above.

According to the invention, a developing device which performs development using a developer containing the toner, or the two-component developer is provided. The developing device performs development using developer containing a toner having excellent low temperature fixability and good environmental characteristics. Therefore, the developing device can perform low temperature fixation, can respond to high speed process, and can stably form an image even though environment is changed.

Further, the invention provides an image forming apparatus comprising the developing device mentioned above.

According to the invention, an image forming apparatus comprises the developing device mentioned above. Therefore, the image forming apparatus can perform low temperature fixation, can respond to high speed process, and can stably form an image even though environment is changed.

BRIEF DESCRIPTION OF DRAWINGS

Other and further objects, features, and advantages of the invention will be more explicit from the following detailed description taken with reference to the drawings where in.

DETAILED DESCRIPTION

Figure 1:
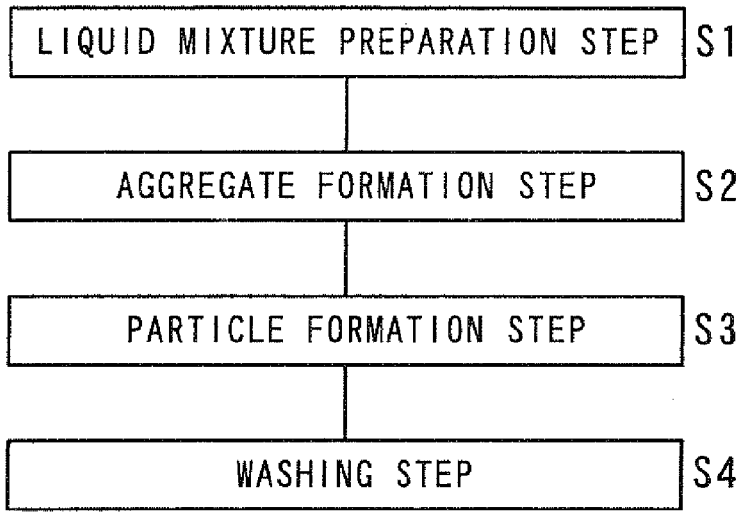
FIG. 1 is a flow chart showing a method for producing a toner according to the invention.

Now referring to the drawings, preferred embodiments of the invention are described below.

1. Constituent Material of Toner (1) Colorant

Examples of a colorant include dye and pigment. Among them, pigment is preferably used. Pigment, has excellent light resistance and color formation properties as compared with pigment. For this reason, use of pigment enables to obtain a toner having excellent light resistance and color formation properties. Specific examples of the colorant include a colorant for yellow toner, a colorant for magenta toner, a colorant for cyan toner and a colorant for black toner.

Specific examples of a colorant for yellow toner include organic pigments such as C.I. Pigment Yellow 1, C.I. Pigment Yellow 5, C.I. Pigment Yellow 12, C.I. Pigment Yellow 15, C.I. Pigment Yellow 17, C.I. Pigment Yellow 74, C.I. Pigment Yellow 93, C.I. Pigment Yellow 180 and C.I. Pigment Yellow 185; inorganic pigments such as yellow iron oxide and yellow ocher; nitro dyes such as C.I. Acid Yellow 1; and oil-soluble dyes such as C.I. Solvent Yellow 2, C.I. Solvent Yellow 6, C.I. Solvent Yellow 14, C.I. Solvent Yellow 15, C.I. Solvent Yellow 19 and C.I. Solvent Yellow 21, that are classified by Color Index.

Specific examples of a colorant for magenta toner include C.I. Pigment Red 49, C.I. Pigment. Red 57, C.I. Pigment Red 81, C.I. Pigment Red 122, C.I. Solvent Red 19, C.I. Solvent Red 49, C.I. Solvent Red 52, C.I. Basic Red 10 and C.I. Disperse Red 15, that are classified by Color Index.

Specific examples of a colorant for cyan toner include C.I Pigment Blue 15, C.I Pigment Blue 16, C.I Solvent Blue 55, C.I Solvent Blue 70, C.I. Direct Blue 25 and C.I. Direct Blue 86, that are classified by Color Index.

Specific examples of a colorant for black toner include carbon blacks such as channel black, roller black, disk black, gas furnace black, oil furnace black, thermal black and acetylene black.

Other than those pigments, showy pink pigments, green pigments and the like can be used. Those colorants may be used each alone, or two or more of colorants having different color may be used in combination. When two or more of the colorants are used, colorants of the same color type may be used in combination, and colorants of plural colors may be used in combination. The content of the colorant can be selected from a wide range according to the characteristics of a toner required, and is preferably from 0.1 to 20 parts by weight, and more preferably from 0.1 to 15 parts by weight, based on 100 parts by weight of the sum of both polyester resins of the crystalline self-dispersion polyester resin and the non-crystalline self-dispersion polyester resin. When the content is less than 0.1 parts by weight, the image formed is difficult to have excellent image density. When the content exceeds 20 parts by weight, the colorant is difficult to ensure its dispersibility in the image formed.

(2) Crystalline Self-Dispersion Polyester Resin

The invention uses a crystalline self-dispersion polyester resin containing at least one carboxyl group as a hydrophilic group. The crystalline self-dispersion polyester resin means a polyester resin having crystallizability and being self-dispersed in water. The term "having crystallizability" means to have a melting point (Tm), and specifically means as follows. Using differential scanning calorimeter (DSC), temperature is elevated from −100° C. to 300° C. at a rate of 20° C./min, the temperature is decreased from 300° C. to −100° C. at a rate of 50° C./min, and the temperature is elevated from −100° C. to 300° C. at a rate of 20° C./min. The resin shows fusion peak in either of the two temperature elevation stages. A resin which is not crystalline is called a non-crystalline resin. The term "self-dispersion" means that the polyester is in a dispersed state in water without adding other substances such as a surfactant. The crystalline polyester resin of the invention contains one or more carboxyl groups. Since the carboxyl group is a hydrophilic group, the crystalline polyester resin is relatively stably dispersed in water having polarity as compared with a resin, which does not contain a hydrophilic group.

The crystalline self-dispersion polyester resin particles of the invention contain a compound represented by the following chemical formula (1) as an alcohol component:

$$H\text{-}(O—CH_2CH_2CH_2CH_2)_n OH \quad (1)$$

wherein n is an integer of from 2 to 50.

In general, an ester is formed by condensation (dehydration) reaction between and acid and an alcohol. The term "containing as an alcohol component" used herein means that a compound obtained by dehydration of an alcohol is contained in a resin molecule. The term "acid component" is used in the same meaning.

The crystalline self-dispersion polyester resin of the invention can stably be dispersed in water by virtue of the presence of the carboxyl group and the compound represented by the chemical formula (1) as an alcohol component therein. In the invention, such a polyester resin can be used without particular limitation. A polyester resin obtained by polycondensation using polycarboxylic acids as an acid and polyhydric alcohols as an alcohol can be used.

Examples of the polycarboxylic acids include aromatic dicarboxylic acids such as terephthalic acid, isophthalic acid, orthophthalic acid, 1,5-naphthalenedicarboxylic acid, 2,6-naphthalenedicarboxylic acid, anthracenedipropionic acid, anthracenedicarboxylic acid, diphenic acid, sulfoterephthalic acid, 5-suifoisophthalic acid, 4-sulfophthalic acid, 4-sulfonaphthalene-2,7-dicarboxylic acid and 5-(4-sulfophenoxy) isophthalic acid; aromatic oxycarboxylic acids such as p-oxybenzoic acid and p-(hydroxyethoxy)benzoic acid; aliphatic dicarboxylic acids such as succinic acid, adipic acid, azelaic acid, sebacic acid and dodecanedicarboxylic acid; aliphatic unsaturated polycarboxylic acids such as fumaric acid, maleic acid, itaconic acid, mesaconic acid and citraconic acid; aromatic unsaturated polycarboxylic acids such as phenylenediacrylic acid; alicyclic dicarboxylic acids such as hexahydrophthalic acid and tetrahydrophthalic acid; and trihydric or more polycarboxylic acids such as trimellitic acid, trimesic acid and pyromellitic acid. Those can be used each alone, or some of them can be selectively used.

The content of the polycarboxylic acids is 70 mol % or more, preferably 80 mol % or more, and particularly preferably 90 mol % or more, per mole of the sum of acids used in polycondensation. The polycarboxylic acids are preferably aromatic polycarboxylic acid. The aromatic polycarboxylic acid preferably contains terephthalic acid and isophthalic acid. The content of the terephthalic acid is preferably from 40 to 95 mol %, more preferably from 60 to 95 mol %, and particularly preferably from 70 to 90 mol %. The content of isophthalic acid is preferably from 5 to 60 mol %. The sum of the contents of terephthalic acid and isophthalic acid is preferably 80 mol % or more, and more preferably 90 mol % or more. In the invention, in particular, it is preferable that the trivalent or more polycarboxylic acids such as trimellitic acid, trimesic acid and pyromellitic acid can be contained each alone, or some of them can be selectively contained, and the content thereof is preferably from 0.5 to 8 mol %, and particularly preferably from 0.5 to 6 mol %.

An acid used in polycondensation may contain monocarboxylic acids. The monocarboxylic acids are preferably aromatic monocarboxylic acid. Examples of the aromatic monocarboxylic acid include benzoic acid, chlorobenzoic acid, bromobenzoic acid, para-hydroxybenzoic acid, naphthalenecarboxylic acid, anthracenecarboxylic acid, 4-methylbenzoic acid, 3-methylbenzoic acid, salicylic acid, thiosalicylic acid, phenylacetic acid, those lower alkyl esters, sulfobenzoic monoammonium salt, sulfobenzoic monosodium salt, cyclohexylaminocarbonylbenzoic acid, n-dodecylaminocarbonylbenzoic acid, tertiary butylbenzoic acid and tertiary butylnaphthalenecarboxylic acid. When the monocarboxylic acids are contained in an acid used in polycondensation, the content thereof is preferably from 2 to 25 mol %, and more preferably from 5 to 20 mol %, per mole of the acid components.

Examples of the polyhydric alcohols include aliphatic polyhydric alcohol, alicyclic alcohol and aromatic polyhydric alcohol. Examples of the aliphatic polyhydric alcohol include aliphatic diols such as ethylene glycol, propylene glycol, 1,3-propanediol, 2,3-butanediol, 1,4-butanediol, 1,5-pentanediol, 1,6-hexanediol, neopentyl glycol, diethylene glycol, dipropylene glycol, 2,2,4-trimethyl-1,3-pentanediol, polyethylene glycol, polypropylene glycol and polytetramethylene glycol; triols such as trimethylol ethane, trimethylol propane, glycerin and pentaerythritol; and tetraols. Examples of the alicyclic polyhydric alcohol include 1,4-cyclohexanediol, 1,4-cyclohexanedimethanol, spiroglycol, hydrogenated bisphenol A, ethylene oxide adduct and propylene oxide adduct of hydrogenated bisphenol A, tricyclodecanediol and tricyclodecanedimethanol. Examples of the aromatic polyhydric alcohol include para-xylene glycol, meta-xylene glycol, ortho-xylene glycol, 1,4-phenylene glycol, ethylene oxide adduct of 1,4-phenylene glycol, bisphenol A, and ethylene oxide adduct and propylene oxide adduct of bisphenol A. Examples of the polyester polyol include lactone-based polyester polyol obtained by ring-opening polymerization of lactone such as ϵ-caprolactone.

The alcohol used in polycondensation is particularly preferably contains 1,4-butanediol. The 1,4-butadiol has the action to increase crystallizability and to decrease softening viscosity of a toner, and therefore, the use thereof can produce a toner which can further easily be fixed. The crystalline polyester resin containing 1,4-butanediol as an alcohol component is stably dispersed in water than a resin which does not contain 1,4-butanediol.

The content of the polyhydric alcohols is 50 mol % or more, preferably 70 mol % or more, further preferably 80 mol % or more, and particularly preferably 90 mol % or more, per mole of the whole alcohols used in polycondensation. At least one of aliphatic diol and alicyclic diol is preferably contained as the polyhydric alcohols. The aliphatic diol is preferably ethylene glycol, propylene glycol and 2,3-butanediol. Among them, ethylene glycol and propylene glycol are more preferred. The alicyclic diols are preferably tricyclodecane dimethanol, cyclohexanediol and cyclohexane dimethanol. Particularly, in the invention, at least one of ethylene glycol and propylene glycol is preferably contained in an amount of 50 mol % or more, preferably 60 mol % or more, and further preferably 70 mol % or more.

Monoalcohols may be contained as an alcohol used in polycondensation in the polyhydric alcohols. Examples of the monoalcohol include aliphatic alcohol, aromatic alcohol and alicyclic alcohol.

The crystalline self-dispersion polyester resin particle preferably has a number average molecular weight of from 2,000 to 80,000. Furthermore, the crystalline self-dispersion polyester resin has a melting point of preferably 80° C. or higher, more preferably 90° C. or higher, and further preferably 100° C. or higher. When the melting point is lower than 80° C., the resin is easily dispersed in water, but toner dependency may be decreased, which is not preferred.

The polyester resin used in the invention has a hydrophilic group concentration of preferably from 5 to 30 mgKOH/g, further preferably from 6 to 25 mgKOH/g, and particularly preferably from 7 to 20 mgKOH/g, in order to satisfy both water dispersibility and water resistance. When the hydrophilic group concentration is lower than 5 mgKOH/g, dispersion stability is decreased. When the hydrophilic group concentration exceeds 30 mgKOH/g, toner becomes moist, and as a result, environmental characteristics may be deteriorated.

(3) Non-Crystalline Self-Dispersion Polyester Resin

The non-crystalline self-dispersion polyester resin can use the conventional polyesters. A polyester resin obtained by polycondensation between an acid and an alcohol, the acid being mainly polycarboxylic acids and the alcohol being mainly polyhydric alcohols, is preferred. The acid and alcohol used in polycondensation can use the same acid and alcohol as in the case of the crystalline self-dispersion polyester resin. The polycondensation is desirably conducted using the acid and alcohol under the same conditions as in the case of the crystalline self-dispersion polyester resin. The non-crystalline self-dispersion polyester resin preferably contains a hydrophilic group in a main chain. A constituent unit containing the hydrophilic group preferably contains a carboxylic acid. More preferably, the constituent unit containing a hydrophilic group does not contain a sulfo group.

The non-crystalline self-dispersion polyester resin particles preferably have a number average molecular weight of from 2,000 to 80,000. The non-crystalline self-dispersion polyester resin has a glass transition temperature of preferably 40° C. or higher, and more preferably from 50 to 80° C. When the glass transition temperature is lower than 40° C., a toner formed using the non-crystalline self-dispersion polyester resin particles has the tendency of blocking, resulting in the problem in storage stability. When the glass transition temperature is higher than 80° C., offset is easily caused. Particularly, when printing is conducted by superposing colors as in color printing, the problem is remarkable. The non-crystalline self-dispersion polyester resin preferably has a softening point of 80 to 150° C. When the softening point is lower than 80° C., a toner formed using the non-crystalline self-dispersion polyester resin causes blocking, and particularly, the problem arises in long-term storage stability. When the softening point is higher than 150° C., a toner formed using the non-crystalline self-dispersion polyester resin gives rise to the problem in fixability, and fixing rolls are required to be heated to high temperature. As a result, material of the fixing rolls and material of a substrate to be transferred are limited.

The non-crystalline self-dispersion polyester resin is mainly obtained by polycondensation of divalent or more polycarboxylic acid and divalent or more polyhydric alcohol as raw materials. Its object is to enhance storage stability of a toner produced by increasing a molecular weight of a polyester resin, and is not to gel the resin. Gelation of a resin makes it difficult to take out the resin form a polymerization apparatus, and this leads to remarkable decrease in productivity. The non-crystalline self-dispersion polyester resin used in the invention does not substantially involve gelation. More specifically, chloroform-insoluble content is 0.5% by weight or less, and preferably 0.25% by weight or less, and acid number is 20 mgKOH/g or less, and preferably 15 mgKOH/g or less.

(4) Wax

The toner of the invention contains a wax, in addition to the colorant, the crystalline self-dispersion polyester resin and the non-crystalline self-dispersion polyester resin. The wax can use the conventional waxes. Examples of the wax used include natural waxes such as carnauba wax and rice wax; synthetic waxes such as polypropylene wax, polyethylene wax, Fischer-Tropsch wax; coal waxes such as montan wax; alcohol waxes; and ester waxes. The waxes may be used each alone, or two or more of them may be used in combination. Wax particles are mixed with a liquid mixture in a liquid mixture preparation step S1. In this case, a wax particle aqueous dispersion previously prepared by mixing wax with water to emulsify is preferably mixed with the liquid mixture. When the wax is contained in a toner component, the content of the wax is preferably from 0.5 to 20 parts by weight, and more preferably from 1 to 10 parts by weight, based on 100 parts by weight of the sum of two polyester resins of the crystalline self-dispersion polyester resin and the non-crystalline self-dispersion polyester resin.

(5) Other Materials

The toner of the invention may contain other toner additive components such as charge control agent, in addition to the colorant, the crystalline self-dispersion polyester resin, the non-crystalline self-dispersion polyester resin and the wax. The charge control agent is added to impart preferable chargeability to the toner. The charge control agent can use charge control agents for controlling positive charge and for controlling negative charge. Examples of the charge control agent include charge control agents for controlling positive charge, such as basic dye, quaternary ammonium salt, quaternary phosphonium salt, aminopyrine, pyrimidine compound, polynuclear polyamino compound, aminosilane, nigrosine dye and its derivative, triphenylmethane derivative, guanidine salt and amidine salt; and charge control agents for controlling negative charge, such as oil-soluble dye (such as oil black and spirone black), metal-containing azo compound, azo complex dye, naphthenic acid metal salt, metal complex and metal salt (metal is chromium, zinc, zirconium, or the like) of salicylic acid and its derivative, boron compound, fatty acid soap, long-chain alkyl carbonate and resin acid soap. The charge control agents may be used each alone, or two or more of them may be used in combination. The amount of the charge control agent used is preferably from 0.5 to 5 parts by weight, and more preferably from 0.5 to 3 parts by weight, based on 100 parts by weight of the sum of two polyester resins of the crystalline self-dispersion polyester resin and the non-crystalline self-dispersion polyester resin. When the content of the charge control agent is larger than 5 parts by weight, a carrier is contaminated, and scattering of the toner is generated. When the content of the charge control agent is less than 0.5 parts by weight, sufficient charging characteristics cannot be imparted to the toner.

2. Method for Producing Toner

FIG. 1 is a flow chart showing a method for producing a toner according to the invention. In a method for producing a toner in the embodiment of the invention, a liquid mixture preparation step S1, an aggregate formation step S2, a particle formation step S3 and a washing step S1 are conducted in this order. In the liquid mixture preparation step S1, a liquid mixture is prepared by mixing a toner component comprising the colorant, the wax and the crystalline self-dispersion polyester resin is mixed with water. In the aggregate formation step S2, an aqueous solution containing an aggregating agent is added to the liquid mixture to form aggregates in an aqueous medium, and an aqueous dispersion of the non-crystalline self-dispersion polyester resin is further added to further perform aggregation. In the particle formation step S3, the aqueous medium containing aggregates is heated to convert the aggregates to particle shape. In the washing step S4, the aggregates in a particle shape are washed and dried.

[Liquid Mixture Preparation Step S1]

In the liquid mixture preparation step S1, the colorant, the wax and the crystalline self-dispersion polyester resin are separately dispersed in water using a stirring machine (an emulsifier or a disperser). Thus, a colorant particle aqueous dispersion containing colorant particles, a wax particle aqueous dispersion containing wax particles, and a crystalline polyester resin particle aqueous dispersion containing crystalline self-dispersion polyester resin particles are prepared, respectively. The thus obtained colorant aqueous dispersion, wax particle aqueous dispersion and crystalline polyester resin particle aqueous dispersion are mixed, followed by stirring. Thus, a liquid mixture containing a toner component is obtained. Preferably, the crystalline polyester resin particle aqueous dispersion and the colorant aqueous dispersion are mixed so as to contain the crystalline self-dispersion polyester resin in an amount of from 80 to 99% by weight and the colorant in an amount of from 0.1 to 20% by weight, in terms of a solid content concentration, and the resulting mixture is stirred using a stirring machine at room temperature for 1 to 5 hours. Thus, a liquid mixture is obtained. The wax particle aqueous dispersion containing at least one of natural and synthetic wax particles emulsified in water is mixed with the liquid mixture obtained above. The amount of the wax particle aqueous dispersion is from 0.1 to 20% by weight in terms of a solid content concentration.

The colorant particle aqueous dispersion containing the colorant is preferably prepared by dispersing the colorant particles in water using a dispersing agent comprising at least one of an anionic surfactant and a nonionic surfactant. This embodiment can reduce a dispersion particle size of the colorant in the toner, and as a result, can produce a toner having further excellent toner characteristics. The dispersing agent is preferably an anionic surfactant and a nonionic surfactant, and is particularly preferably an anionic surfactant. Dispersing the colorant particles using such a dispersing agent can reduce a dispersion particle size of the colorant in the toner, and as a result, can produce a toner having further excellent characteristics. Unnecessary dispersing agent can be removed by the washing step.

Method for producing the crystalline polyester resin particle aqueous dispersion containing the crystalline self-dispersion polyester resin particles is not particularly limited. The methods include a phase inversion emulsification method of dissolving the crystalline polyester resin in an organic solvent to conduct phase inversion in water, a method of heating the crystalline polyester resin to a temperature at which the resin is sufficiently melted, and mixing and dispersing the melt in an alkaline water to emulsify, and a method of mechanically dispersing the crystalline polyester resin using a surfactant. The phase inversion method of swelling or dissolving the crystalline polyester resin with an organic solvent to emulsify, without using a surfactant is preferably used.

The temperature when the crystalline self-dispersion polyester resin is swelled or dissolved with an organic solvent is preferably from 40 to 250° C., more preferably from 50 to 220° C., further preferably from 60 to 220° C., and most preferably from 70 to 200° C. When the temperature is lower than 40° C., the crystalline self-dispersion polyester resin may not sufficiently be dissolved or swelled. As a result, entanglement of molecular chains with each other cannot sufficiently be disentangled. When the temperature exceeds 250° C., the temperature may lead to increased decomposition of the crystalline self-dispersion polyester resin.

Examples of the organic solvent that can dissolve or swell the crystalline self-dispersion polyester resin by heating at a temperature in a range of from 40 to 250° C. include methyl ethyl ketone, dimethyl acetamide, dimethyl formamide, N-methyl pyrrolidone, tetrahydrofuran, 1,4-dioxane, 1,3-dioxane, 1,3-dioxolan, 1,2-hexanediol, methyl cellosolve, butyl cellosolve, ethyl carbitol, butyl carbitol, propylene glycol monopropyl ether, propylene glycol monobutyl ether, and triethylene glycol monobutyl ether. Among them, methyl ethyl ketone, butyl cellosolve, propylene glycol monopropyl ether and propylene glycol monobutyl ether are preferred.

The crystalline self-dispersion polyester resin particles contain a carboxyl group as a hydrophilic group. Therefore, the carboxyl group is partially or entirely neutralized with a basic substance to achieve dispersion stabilization in an organic solvent. Examples of the basic substance that can be used in neutralization include amines such as ammonia and triethylamine, and inorganic bases such as sodium hydroxide and potassium hydroxide. A volatile amine compound is preferably used to avoid the possibilities of retaining in a toner and deterioration of environmental characteristics. Two or more of those organic base; compounds can be used in combination freely.

Water is added to the crystalline self-dispersion polyester resin solution thus formed, followed by stirring. Thus, the solution is phase-inverted to an aqueous system. Water is not added at once, but is preferably gradually added while maintaining the temperature of the solution in the production of a stable aqueous dispersion.

If necessary, the organic solvent used in the preparation of the crystalline polyester resin particle aqueous dispersion can be removed after obtaining the aqueous dispersion. In such a case, of the solvents described above, a solvent having a boiling point lower than 100° C. is preferably selected. The aqueous dispersion of the invention may contain a small amount of the organic solvent.

The volume average particle size of the dispersed particles in the crystalline self-dispersion polyester resin particle aqueous dispersion greatly affects the production of a toner, and is very important. The volume average particle size is preferably 0.3 μm or less, more preferably from 0.01 to 0.2 μm, and particularly preferably from 0.01 to 0.1 μm. When the particle size exceeds 0.3 μm, dispersion stability is decreased. Furthermore, aggregated particles are coarsened, and the particles cannot be granulated into toner particles having the desired particle size. Coarse particles of 1 μm or more are present in an amount of 1% or less, preferably 0.5% or less, and more preferably 0.2% or less, in the whole particles. When the coarse particles of 1 μm or more are present in an amount exceeding 1%, particle size distribution of the toner is broadened, which is not preferred.

[Aggregate Formation Step S2]

In the aggregate formation step S2, a given amount of an aggregating agent (polyvalent metal salt) is added to the liquid mixture containing the toner component comprising the colorant particles, wax particles and the crystalline self-dispersion polyester resin particles, and the resulting mixture was mixed by stirring. Thus, aggregates (preferably, the volume average particle size is 10 μm or less) containing the toner component are formed. Due to that the volume average particle size of the aggregates is 10 μm or less, a toner that can form high definition and high resolution image can be obtained. When the volume average particle size of the aggregates exceeds 10 μm, a toner that can form an image with sufficiently high definition and with high resolution may not be obtained. The volume average particle size can be adjusted by the concentration of polyvalent metal salt added, the stirring rate, or the temperature of the liquid mixture.

The polyvalent metal salt can use the conventional metal salts. Metal salts wherein metal is magnesium, aluminum or calcium are preferably used.

The step S2 is preferably conducted at room temperature. Heating to the vicinity of a glass transition temperature (Tg) of the crystalline self-dispersion polyester resin may be conducted. Additionally speaking, in the step S2, stirring the liquid mixture by mechanical shear force using a stirring machine is preferred from the standpoint that the aggregates are easily formed into particles having uniform particle size and shape. The stirring machine can use the conventional emulsifier and disperser. An apparatus that can receive the toner component and the aqueous medium in a batchwise manner or a continuous manner, is provided with a heating section, forms a toner as binder resin particles containing a colorant by mixing the toner component and the aqueous medium under heating, and can discharge the toner in a batchwise manner or a continuous manner, is preferably used. The emulsifier and the disperser are preferably ones that can impart shear force to a mixture of the toner and the aqueous medium, in that the aggregates formed are further easily formed into particles having uniform particle size and shape. Furthermore, the emulsifier and the disperser preferably have at least one of a stirring section and a rotating section, and can mix the toner and the aqueous medium under stirring or under rotating. The emulsifier and disperser is preferably that a mixing container for mixing the toner and the aqueous medium has a thermal insulation section.

Specific examples of the emulsifying machine and the dispersing machine include: a batch-type emulsifying machine such as ULTRA-TURRAX (trade name) manufactured by IKA Japan K.K., POLYTRON HOMOGENIZER (trade name) manufactured by Kinematica AG, T.K. AUTO-HOMOMIXER (trade name) manufactured by Tokushu Kika Kogyo Co., Ltd., and MAXBLEND (trade name) manufactured by Sumitomo Heavy Industries, Ltd.; a continuous-type emulsifying machine such as EBARAMILDER (trade name) manufactured by Ebara Corporation, T.K. PIPELINE HOMO MIXER (trade name) manufactured by Tokushu Kika Kogyo Co., Ltd., T.K. HOMOMIC LINE FLOW (trade name) manufactured by Tokushu Kika Kogyo Co., Ltd., FILMIX (trade name) manufactured by Tokushu Kika Kogyo Co., Ltd., COLLOID MILL (trade name) manufactured by Shinko Pantec Co., Ltd., SLUSHER (trade name) manufactured by Mitsui Miike Kakoki Co., Ltd., TRIGONAL WET GRINDER (trade name) manufactured, by Mitsui Miike Kakoki Co., Ltd., CAVITRON (trade name) manufactured by Eurotec, Ltd., and FINE FLOW MILL (trade name) manufactured by Pacific Machinery & Engineering Co., Ltd.; CLEARMIX (trade name) manufactured by M Technique Co., Ltd.; and FILMIX (trade name) manufactured by Tokushu Kika Kogyo Co., Ltd.

In the aggregate formation step S2, a given amount of the non-crystalline self-dispersion polyester resin particle aqueous dispersion containing the non-crystalline self-dispersion polyester resin particles is mixed. Preferably, the non-crystalline self-dispersion polyester resin is added in an amount of from 20 to 80 parts by weight based on 100 parts by weight of the sum of the two polyester resins of the crystalline self-dispersion polyester resin and the non-crystalline self-dispersion polyester resin.

A method for producing the non-crystalline polyester resin particle aqueous dispersion containing the non-crystalline self-dispersion polyester resin particles is not particularly limited. Examples of the method include a phase inversion emulsification method of dissolving the non-crystalline polyester resin in an organic solvent to conduct phase inversion in water, a method of heating the non-crystalline polyester resin to a temperature at which the resin is sufficiently melted, and mixing and dispersing the melt in an alkaline water to emulsify, and a method of mechanically dispersing the non-crystalline polyester resin using a surfactant. A phase inversion method of swelling or dissolving the non-crystalline polyester resin with an organic solvent to emulsify, without using a surfactant is preferably used.

The temperature when the non-crystalline self-dispersion polyester resin is swelled or dissolved with an organic solvent is preferably from 40 to 250° C., more preferably from 50 to 220° C., further preferably from 60 to 220° C., and most preferably from 70 to 200° C. When the temperature is lower than 40° C., the non-crystalline self-dispersion polyester resin may not sufficiently be dissolved or swelled. As a result, entanglement of molecular chains with each other cannot sufficiently be disentangled. When the temperature exceeds 250° C., the temperature may lead to increased decomposition of the non-crystalline self-dispersion polyester resin.

Examples of the organic solvent that can dissolve or swell the non-crystalline self-dispersion polyester resin by heating at a temperature in a range of from 40 to 250° C. include methyl ethyl ketone, dimethyl acetamide, dimethyl formamide, N-methyl pyrrolidone, tetrahydrofuran, 1,4-dioxane, 1,3-dioxane, 1,3-dioxolan, 1,2-hexanediol, methyl cellosolve, butyl cellosolve, ethyl carbitol, butyl carbitol, propylene glycol monopropyl ether, propylene glycol monobutyl ether, and triethylene glycol monobutyl ether. Among them, methyl ethyl ketone, butyl cellosolve, propylene; glycol monopropyl ether and propylene glycol monobutyl ether are preferred.

The non-crystalline self-dispersion polyester resin particles contain a carboxyl group as a hydrophilic group. Therefore, the carboxyl group is partially or entirely neutralized with a basic substance to achieve dispersion stabilization in an organic solvent. Examples of the basic substance that can be used in neutralization include amines such as ammonia and triethylamine, and inorganic bases such as sodium hydroxide and potassium hydroxide. A volatile amine compound is preferably used to avoid the possibilities of retaining in a toner and deterioration of environmental characteristics. Two or more of those organic base compounds can be used in combination freely.

Water is added to the non-crystalline self-dispersion polyester resin solution thus formed, followed by stirring. Thus, the solution is phase-inverted to an aqueous system. Water is not: added at once, but is preferably gradually added while maintaining the temperature of the solution in the production of a stable aqueous dispersion.

If necessary, the organic solvent used in the preparation of the non-crystalline polyester resin particle aqueous dispersion can be removed after obtaining the aqueous dispersion. In such a case, of the solvents described above, a solvent having a boiling point lower than 100° C. is preferably selected. The aqueous dispersion of the invention may contain a small amount of the organic solvent.

The volume average particle size of the dispersed particles in the non-crystalline self-dispersion polyester resin particle aqueous dispersion greatly affects the production of a toner, and is very Important. The volume average particle size is preferably 0.3 μm or less, more preferably from 0.01 to 0.2 μm, and particularly preferably from 0.01 to 0.1 μm. When the particle size exceeds 0.3 μm, dispersion stability is decreased. Furthermore, aggregated particles are coarsened, and the particles cannot be granulated into toner particles having the desired particle size. Coarse particles of 1 μm or more are present in an amount of 1% or less, preferably 0.5% or less, and more preferably 0.2% or less, in the whole particles. When the coarse particles of 1 μm or more are present in an amount exceeding 1%, particle size distribution of the toner is broadened, which is not preferred.

When the non-crystalline self-dispersion polyester resin particle aqueous dispersion is mixed and aggregation is further conducted, the polyvalent metal salt may be added as an aggregating agent. After aggregation of the non-crystalline self-dispersion polyester resin particles, a surfactant may be added to prevent, reaggregation of aggregates with each other, and sodium hydroxide or the like may be added to adjust pH to 8 or higher.

[Particle Formation Step S3]

In the particle formation step S3, an aqueous medium containing the aggregates obtained is heated to form the aggregates into particles having nearly uniform particle size and shape. In this case, the aqueous medium is preferably heated to a glass transition temperature or higher of the crystalline self-dispersion polyester resin to adjust the particle size to 1 to 10 μm. This heating permits to easily obtain toner particles having nearly uniform particle size and shape.

[Washing Step S4]

In the washing step S4, the liquid mixture containing a toner (aggregates) is cooled to room temperature, and filtered, and a supernatant is removed. The toner separated is washed with water. The washing preferably uses pure water having conductivity of 20 μS/cm or less. The toner is preferably washed until a supernatant of water which has washed the toner has conductivity of 50 μS/cm or less. The pure water can be obtained by the conventional methods such as an activated carbon method, an ion-exchange method, a distillation method and a reverse osmosis method. Some of those methods may be combined. The temperature of pure water at washing is preferably a glass transition temperature or lower of the resin from the standpoint of reaggregation. Washing of the toner with pure water may be conducted in a batchwise manner or a continuous manner. The washing of the toner with pure water is conducted to remove unnecessary components other than the toner component, such as impurities affecting chargeability of the toner and unnecessary aggregating agent that did not participate to aggregation, and the washing permits to easily produce a toner that does not contain unnecessary components. One or more step of washing with water having pH of 6 or lower may be included during the washing step with pure water, and removal, of impurities is further sufficiently be conducted, by the procedure. The toner thus washed is separated, from the washing water by filtration, and then dried using a vacuum drier or the like.

3. Toner

The toner obtained by drying is a toner such that at least one of a crystalline self-dispersion polyester resin component and a colorant component is present in the vicinity of the surface in small amount, and is present in the inside in large amount. A toner having the both components present in the inside in large amount is particularly desired. Difference in charge amount due to difference in the colorant can be decreased by deducing the colorant component in the vicinity of the surface, and storage stability of the toner can be enhanced by reducing the crystalline self-dispersion polyester resin component in the vicinity of the surface.

The toner of the invention may be subjected to surface modification of toner particles by adding external additives. The external additives can use the conventional external additives. Examples of the external additives include water-dispersible inorganic particles such as silica and titanium oxide. The inorganic particles have an average particle size of 1 μm or less, and preferably from 0.01 to 0.8 μm. The inorganic particles can be used each alone, or two or more of them can be used in combination. The surface treatment may be applied to the toner by adding a silicone resin or the like to the external additives. The amount of the external additives added is preferably from 1 to 1.0 parts by weight based on 100 parts by weight of the toner particles.

The toner has a volume average particle size of preferably 10 μm or less, more preferably from 2 to 9 μm, and particularly preferably from 3 to 8 μm. When the volume average particle size exceeds 10 μm, the particle size distribution is broadened on the production method of the toner, and scattering of chargeability is large, resulting in disturbance of an image.

4. Two-Component Developer

The toner of the invention can be used as a one-component developer or a two-component developer. When the toner is used as a one-component developer, the toner alone is used without using a carrier. The toner is adhered on a sleeve by frictionally charging with a development sleeve using a blade and a fur brush, and the toner is transferred. Thus, and image is formed.

When the toner is used as a two-component developer, the toner is used together with a carrier. The carrier can use the conventional carriers. Examples of the carrier include carriers comprising single or composite ferrite or carrier core particles comprising iron, copper, zinc, nickel, cobalt, manganese and chromium, surface-covered with a coating material. The coating material can use the conventional coating materials, and examples of the coating material include polytetrafluoroethylene, monochlorotrifluoroethylene polymer, polyvinylidene fluoride, silicone resin, polyester resin, metal compound of ditertiary butyl salicylic acid, styrenic resin, acrylic resin, polyacid, polyvinylal, nigrosine, aminoacrylate resin, basic dye, lake of basic dye, silica fine powder and alumina fine powder. The coating material is preferably selected according to the toner component. The coating materials may be used each alone, or two or more of them may be used in combination. The carrier has an average particle size of preferably from 10 to 100 μm, and more preferably from 20 to 80 μm.

5. Developing Device and Image Forming Apparatus

Figure 2:
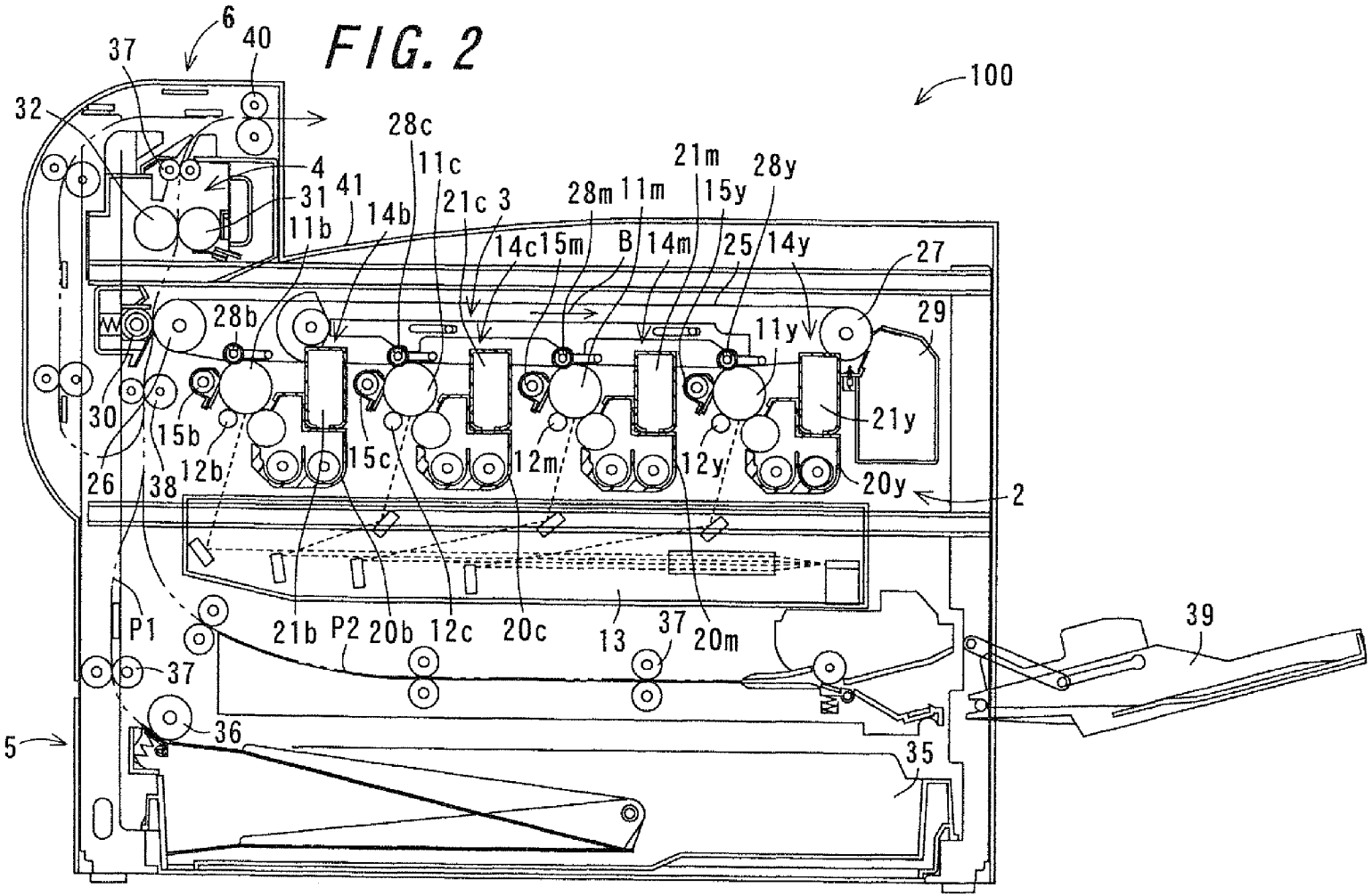
FIG. 2 is a schematic view schematically showing the constitution of an image forming apparatus according to one embodiment of the invention.

FIG. 2 is a schematic view schematically showing the constitution of an image forming apparatus 100 according to one embodiment of the invention. The image forming apparatus 100 is a multifunctional peripheral having a copying function, a printer function and a facsimile function in combination, and forms a full-color or black-and-white image on a recording medium according to image information transmitted. Specifically, the image forming apparatus 100 has three kinds of printing modes of copier mode (copying mode), printer mode and facsimile mode. The printing mode is selected by a control unit (not shown) according to operation input from an operation section (not shown), and reception of printing job from external instruments using a personal computer, a mobile terminal unit, an information memory medium and a memory unit. The image forming apparatus 100 comprises a toner image forming section 2, a transfer section 3, a fixing section 4, a recording medium feeding section 5 and a discharging section 6.

Each member constituting the toner image formation section 2 and some members contained in the transfer section 3 are provided every four members, respectively, in order to respond to image information of each color of black (b), cyan (c), magenta (m) and yellow (y) contained in a color image information. Each member provided every 4 members according to each color is distinguished by adding the alphabet showing each color to the end of the reference numerals. In the case of generic designation, only the reference numeral is indicated.

The toner image forming section 2 comprises a photoreceptor drum 11, a charging section 12, an exposure unit 13, a developing device 14 and a cleaning unit 15. The charging section 12, the developing device 14 and the cleaning unit 15 are provided around the photoreceptor drum 11 in this order. The charging section 12 is provided at a position lower than the cleaning unit 15 in a vertical direction, and at a position equal to that of the developing device 14 in a vertical direction.

The photoreceptor drum 11 is rotatably supported around a shaft line by a driving section (not shown), and comprises a conductive substrate (not shown) and a photosensitive layer (not shown) formed on the surface of the conductive substrate. The conductive substrate can have various shapes. Examples of the shape include cylindrical shape, columnar shape and thin film sheet shape. Among them, cylindrical shape is preferred. The conductive substrate is formed of a conductive material. The conductive material can use the materials generally used in the art of this field. Examples of the material include metals such as aluminum, copper, brass, zinc, nickel, stainless steel, chromium, molybdenum, vanadium, indium, titanium, gold and platinum, and alloys of at least two metals; conductive films obtained by forming a conductive layer comprising at least one of aluminum, aluminum alloy, tin oxide, gold and indium oxide on a film-shaped substrate such as synthetic resin film, metal film and paper; and resin composition containing at least one of conductive particles and conductive polymer. The film-shaped substrate used in the conductive film is preferably a synthetic resin, and particularly preferably a polyester film. The formation method of the conductive layer in the conductive film is preferably vapor deposition and coating.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. Provision of the undercoat layer offers advantages such as covering the flaws and irregularities present on the surface of the conductive substrate to thereby smooth the surface of the photosensitive layer, preventing degradation of the chargeability of the photosensitive layer during repetitive use, and enhancing the charging property of the photosensitive layer under at least one of a low temperature and low humidity circumstance. Further, the photosensitive layer may be a laminated photoreceptor having a highly-durable three-layer structure in which a photoreceptor surface-protecting layer is provided on the top layer.

The charge generating layer contains as a main ingredient a charge generating substance that generates charges under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generation ability and are suitable for obtaining a photosensitive layer at high sensitivity. The charge generating substances may be used each alone, or two or more of them may be used in combination. The content of the charge generating substance is not particularly limited, and preferably from 5 to 500 parts by weight and more preferably from 10 to 200 parts by weight based on 100 parts by weight of binder resin in the charge generating layer.

The binder resin for charge generating layer can use the binder resins generally used in the art of this field. Examples of the binder resin include melamine resin, epoxy resin, silicone resin, polyurethane, acrylic resin, vinyl chloride/vinyl acetate copolymer resin, polycarbonate, phenoxy resin, polyvinyl butyral, polyacrylate, polyamide and polyester. The binder resins may be used each alone, or two or more of them may be used in combination, if necessary.

The charge generating layer can be formed by dissolving or dispersing an appropriate amount of a charge generating substance, binder resin and, optionally, a plasticizer, a sensitizer, etc. respectively in an appropriate organic solvent which is capable of dissolving or dispersing the ingredients described above, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 to 5 μm and more preferably from 0.1 μm to 2.5 μm.

The charge transporting layer stacked over the charge generating layer contains as an essential ingredient a charge transporting substance having an ability of receiving and transporting charges generated from the charge generating substance, and binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole and a derivative thereof, poly-γ-carbazolyl ethyl glutamate and a derivative thereof, a pyrene-formaldehyde condensation product and a derivative thereof, polyvinylpyrene, polyvinyl phenanthrene, an oxazole derivative, an oxadiazole derivative, an imidazole derivative, 9-(p-diethylaminostyryl)anthracene, 1,1-bis(4-dibenzylaminophenyl) propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone. The charge transporting substances may be used each alone, or two or more of them may be used in combination. The content of the charge transporting substance is not particularly limited, and preferably from 10 to 300 parts by weight and more preferably from 30 to 150 parts by weight based on 100 parts by weight of the binder resin in the charge transporting substance.

The binder resin for charge transporting layer can use binder resins generally used in the art of this field and capable of uniformly dispersing the charge transporting substance. Examples of the binder resin include polycarbonate, polyacrylate, polyvinyl butyral, polyamide, polyester, polyketone, epoxy resin, polyurethane, polyvinyl ketone, polystyrene, polyacrylamide, phenol resin, phenoxy resin, polysulfone resin, and their copolymer resins. Among them, polycarbonate containing bisphenol Z as a monomer component (hereinafter referred to as "bisphenol Z type polycarbonate"), and mixtures of the bisphenol Z type polycarbonate and other polycarbonate are preferred, considering film formability, and abrasion resistance and electrical characteristics of the charge transporting layer obtained. The binder resins may be used each alone, or two or more of them may be used in combination.

The charge transporting layer preferably contains an antioxidant together with the charge transporting substance and the binder resin for charge transporting layer. Also for the antioxidant, materials used customarily in the relevant field can be used including, for example, Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more of the antioxidants may be used in combination. The content of the antioxidant is not particularly limited, and is 0.01% by weight to 10% by weight and preferably 0.05% by weight to 5% by weight based on the total amount of the ingredients constituting the charge transporting layer.

The charge transporting layer can be formed by dissolving or dispersing appropriate amounts of the charge transporting substance, the binder resin, and if necessary, an antioxidant, a plasticizer and a sensitizing agent in an appropriate organic solvent capable of dissolving or dispersing those components to prepare a coating liquid for charge transporting layer, applying the coating liquid for charge transporting layer to the surface of a charge generating layer, and drying the coating. The film thickness of the charge generating layer thus obtained is not particularly limited. The film thickness is preferably from 10 to 50 μm, and more preferably from 15 to 40 μm. A photosensitive layer having a charge generating substance and a charge transporting substance present therein can be formed in one layer. In this case, the kind and content of the charge generating substance and the charge transporting substance, the kind of the binder resin, and other additives are the same as in the case of separately forming the charge generating layer and the charge transporting layer.

In the present embodiment, the photoreceptor drum having formed thereon an organic photosensitive layer comprising the charge generating substance and the charge transporting substance as described before is used. However, a photoreceptor drum having formed thereon an inorganic photosensitive layer comprising silicone or the like can be used in place of the photoreceptor drum.

The charging section 12 faces the photoreceptor drum 11 and is disposed away from the surface of the photoreceptor drum 11 along a longitudinal direction thereof so that a gap is formed between the charging section 12 and the photoreceptor drum 11. The charging section 12 charges the surface of the photoreceptor drum 11 so that the surface of the photoreceptor drum 11 has predetermined polarity and potential. As the charging section 12, it is possible to use a charging brush type charger, a charger type charger, a saw tooth type charger, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum. It is also possible use a contact-charging type charger such as a charging brush or a magnetic brush.

The exposure unit 13 is disposed so that light corresponding to respective color information emitted from the exposure unit 13 passes between the charging section 12 and the developing section 14 to reach the surface of the photoreceptor drum 11. The exposure unit 13 converts the image information to light corresponding to respective color information of black (b), cyan (c), magenta (m), and yellow (y) therein, and the surface of the photoreceptor drum 11 which has been evenly charged by the charging section 12, is exposed to the light corresponding to the respective color information to thereby form an electrostatic latent image on the surface of the photoreceptor drum 11. As the exposure unit 13, it is possible to use a laser scanning unit having a laser-emitting portion and a plurality of reflecting mirrors. The other usable examples of the exposure unit 13 may include an LED (light emitting diode) array and a unit in which a liquid-crystal, shutter and a light source are appropriately combined with each other.

Figure 3:
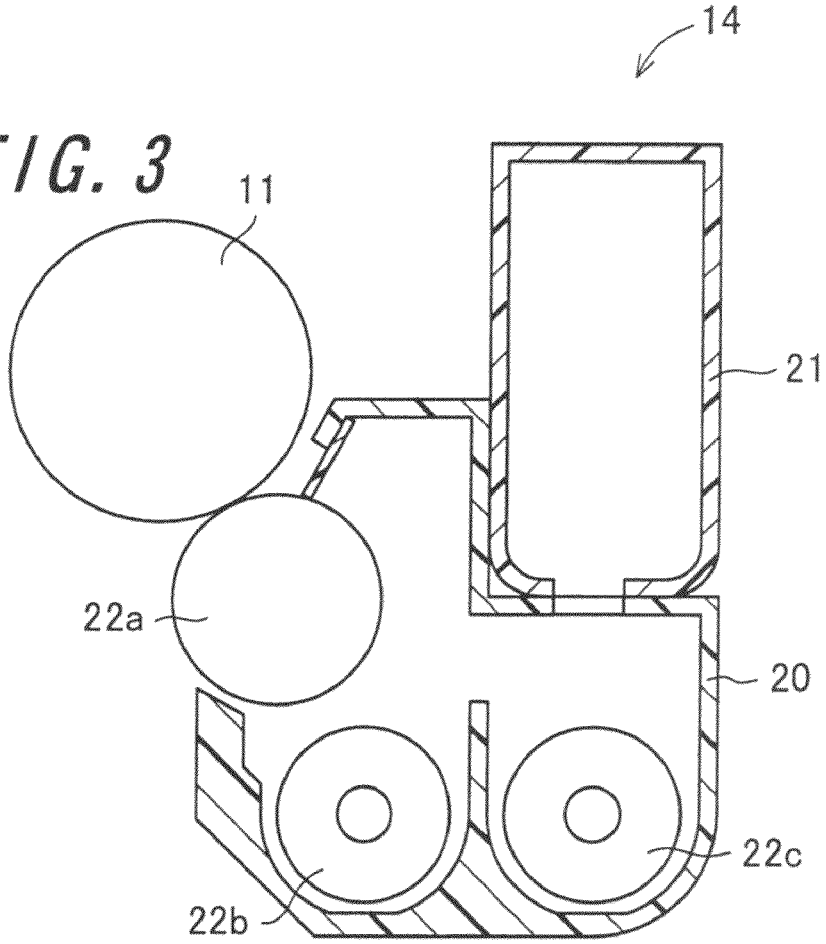
FIG. 3 is a schematic view schematically showing the constitution of a developing device according to one embodiment of the invention.

FIG. 3 is a schematic view schematically showing the constitution of the developing device 14 according to one embodiment of the invention. The developing device 14 comprises a developing tank 20 and a toner hopper 21. The developing tank 20 is provided so as to face the surface of the photoreceptor drum 11, and is a container-shaped, member which feeds a toner to an electrostatic latent image formed on the surface of the photoreceptor drum 11, develops the latent image, and forms a toner image as a visible image. The developing tank 20 has the toner in its internal space, and comprises roller members such as a developing roller, a supplying roller **22*b* and an agitating roller 22*c*, or screw members, in a rotatable state, which are supported rotatably. An opening is formed at the side facing the photoreceptor drum 11 of the developing tank 20, and the developing roller 22*a* is rotatably provided at the position facing the photoreceptor drum 11** through the opening.

The developing roller **22*a* is a roller-shaped member, and supplies a toner to the electrostatic latent image on the surface of the photoreceptor drum 11 at a pressure-contact portion or most-adjacent portion between the developing roller 22*a* and the photoreceptor drum 11. When the toner is supplied, to a surface of the developing roller 22*a* is applied a potential whose polarity is opposite to a polarity of the potential of the charged toner, which serves as a development bras voltage. By so doing, the toner on the surface of the developing roller 22*a*** is smoothly supplied to the electrostatic latent image. Furthermore, an amount of the toner being supplied to the electrostatic latent image (a toner attachment amount) can be controlled by changing a value of the development bias voltage.

The supplying roller 22*b* is a roller-shaped member rotatably provided facing the developing roller, and feeds the toner around the developing roller 22*a*. The agitating roller 22*c* is a roller-shaped member rotatably provided facing the supplying roller 22*b*, and sends the toner freshly fed in the developing tank 20 from the toner hopper 21 around the feed roller. The toner hopper 21 is provided such that a toner replenishment port (not shown) provided at a lower part in a vertical direction is communicated with a toner reception port (not shown) provided at an upper part in the vertical direction of the developing tank 20, and replenishes the toner according to consumption state of the toner in the developing tank 20. The developing device may be constituted such that the toner is directly replenished from a toner cartridge of each color without using the toner hopper 21.

The developing device which performs development using the developer containing the toner of the invention, or the two-component developer of the invention can maintain storage stability while ensuring low temperature fixability of the toner, can maintain stable performance to stress such as agitating in the developing tank, and can form a high quality toner image on the photoreceptor.

A cleaning unit 15 removes the toner which remains on the surface of the photoreceptor drum 11 after the toner image has been transferred to the recording medium, and cleans the surface of the photoreceptor drum 11. In the cleaning unit 15 is used a platy member such as a cleaning blade. In the image forming apparatus 1 according to the embodiment, an organic photoreceptor drum is used as the photoreceptor drum 11. Since a surface of the organic photoreceptor drum contains a resin component as a main ingredient, a chemical action of ozone caused by corona discharging through the charging device promotes the deterioration of the surface of the organic photoreceptor drum. The degraded surface part is, however, worn away by abrasion through the cleaning unit 15 and reliably, though gradually, removed. Accordingly, the problem of the surface degradation caused by the ozone is actually solved, and it is thus possible to stably maintain the potential of charges given by the charging operation over a long period of time. Although the cleaning unit 15 is provided in the embodiment, no limitation is imposed on the configuration, and there may be no cleaning unit 15.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing section 14 to the electrostatic latent image, thereby forming a toner image; the toner image is transferred to an intermediate transfer belt 25; and the toner which remains on the surface of the photoreceptor drum 11 is removed by the cleaning unit 15. A series of a toner image forming operation just described is repeatedly carried out.

The transfer section 3 is provided above the photoreceptor drum 11, and comprises an intermediate transfer belt 25, a driving roller 26, a driven roller 27, an intermediate transfer roller 28 (b, c, m and y), a transfer belt cleaning unit 29, and a transfer roller 30. The intermediate transfer belt 25 is an endless belt-shaped member supported around the driving roller 26 and the driven roller 27 with tension, thereby forming forms a loop-shaped travel path, and rotationally drives in the direction of the arrow B. When the intermediate transfer belt 25 passes by the photoreceptor drum 11 in contact therewith, transfer bias voltage having reverse polarity to the charging polarity of the toner on the surface of the photoreceptor drum 11 is applied from the intermediate transfer roller 28 provided facing the photoreceptor drum 11 with the intermediate transfer belt 25 interposed therebetween, and a toner image formed on the surface of the photoreceptor drum 11 is transferred onto the intermediate transfer belt 25. In the case of full-color image, toner images of the respective colors formed on the respective photoreceptor drums 11 are sequentially transferred and overlaid onto the intermediate transfer belt 25, thus forming a full-color toner image.

The driving roller 26 can rotate around an axis thereof with the aid of a driving section (not shown), and the rotation of the driving roller 26 drives the intermediate transfer belt 25 to rotate in the arrow B direction. The driven roller 27 can be driven to rotate by the rotation of the driving roller 26, and imparts constant tension to the intermediate transfer belt 25 so that the intermediate transfer belt 25 does not go slack. The intermediate transfer roller 28 is disposed in pressure-contact with the photoreceptor drum 11 via the intermediate transfer belt 25, and capable of rotating around its own axis by a driving section (not shown). The intermediate transfer belt 28 is connected to a power source (not shown) for applying the transfer bias voltage as described above, and has a function of transferring the toner image formed on the surface of the photoreceptor drum 11 to the intermediate transfer belt 25.

The transfer belt cleaning unit 29 is provided so as to face the driven roller 27 with the intermediate transfer belt 25 interposed therebetween and come into contact with the circumference of the intermediate transfer belt 25. When the toner attached to the intermediate transfer belt 25 by the contact with the photoreceptor drum 11 is attached to the transfer roller 30, the attached toner leads to contamination of the back of a recording medium. Therefore, the transfer belt cleaning unit 29 removes and recovers the toner on the surface of the intermediate transfer belt 25. The transfer roller 30 comes into pressure-contact with the driving roller 26 with the intermediate transfer belt 25 interposed therebetween, and is rotatably provided around an axis thereof by a driving section (not shown). In a pressure-contact region between the transfer roller 30 and the driving roller 26 (transfer nip region), a toner image conveyed while borne on the intermediate transfer belt 25 is transferred to a recording medium sent from a recording medium feeding section 5 described hereinafter. The recording medium supporting the toner image is sent to the fixing section 4.

In the transfer section 3, the toner image is transferred from the photoreceptor drum 11 onto the intermediate transfer belt 25 at the pressure-contact portion between the photoreceptor drum 11 and the intermediate transfer roller 28, and by the intermediate transfer belt 25 rotating in the arrow B direction, the transferred toner image is conveyed to the transfer nip region where the toner image is transferred onto the recording medium.

The fixing section 4 is provided downstream of the transfer section 3 along a conveyance direction of the recording medium, and comprises a fixing roller 31 and a pressure roller 32. The fixing roller 31 can rotate by a driving section (not shown), and heats the toner constituting an unfixed toner image borne on the recording medium so that the toner is fused. Inside the fixing roller 31 is provided a heating portion (not shown). The heating portion heats the heating roller 31 so that a surface of the heating roller 31 has a predetermined temperature (heating temperature). For the heating portion, a heater, a halogen lamp, and the like device can be used. The heating portion is controlled by a fixing condition control portion.

A temperature detecting sensor is provided in the vicinity of the surface of the fixing roller 31, and detects the surface temperature of the fixing roller 31. The detection result by the temperature detecting sensor is written in a memory portion of a control unit, described hereinafter. The pressure roller 32 is provided so as to come into pressure-contact with the fixing roller 31, and is supported rotatably according to rotation drive of the fixing roller 31. The pressure roller 32 fixes a toner image to the recording medium in cooperation with the fixing roller 31. At this time, the pressure roller 32 presses the toner image in a fused state against the recording medium, thereby assisting fixation of the toner image to the recording medium. The pressure-contact region between the fixing roller 31 and the pressure roller 32 is a fixing nip region.

In the fixing section 4, the recording medium having the toner image transferred in the transfer section 3 is sandwiched between the fixing roller 31 and the pressure roller 32. When the recording medium is passed through the fixing nip region, the toner image is pressed to the recording medium under heating. As a result, the toner image is fixed to the recording medium, and an image Is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path P1. The conveying rollers 37 are a pair of roller members disposed in pressure-contact with each other, and convey the recording medium toward the registration rollers 38. The registration rollers 38 are a pair of roller members disposed in pressure-contact with each other, and feed to the transfer nip region the recording medium fed from the conveying rollers 37 in synchronization with the conveyance of the toner image borne on the intermediate transfer belt 25 to the transfer nip region.

The manual paper feed tray 39 is a device storing recording mediums which are different from the recording mediums stored in the automatic paper feed tray 35 and may have any size and which are to be taken into the image forming apparatus, and the recording medium taken in from the manual paper teed tray 39 passes through a paper conveyance path P2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip region in synchronization with the conveyance of the toner image borne on the intermediate transfer belt 25 to the transfer nip region.

The discharging section 6 includes the conveying rollers 37, discharging rollers 40, and a catch tray 41. The conveying rollers 37 are disposed downstream of the fixing nip region along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus. The catch tray 41 stores the recording medium onto which the image has been fixed.

The image forming apparatus includes a control unit (not shown). The control unit is disposed, for example, in an upper part of an internal space of the image forming apparatus, and contains a memory portion, a computing portion, and a control portion. To the memory portion of the control unit are input, for example, various set values obtained by way of an operation panel (not shown) disposed on the upper surface of the image forming apparatus, results detected from a sensor (not shown) etc. disposed in various portions inside the image forming apparatus, and image information obtained from an external equipment. Further, programs for operating various functional elements are written. Examples of the various functional elements include a recording medium determining portion, an attachment amount control portion, and a fixing condition control portion. For the memory portion, those customarily used in the relevant filed can be used including, for example, a read only memory (ROM), a random access memory (RAM), and a hard disc drive (HDD). For the external equipment, it is possible to use electrical and electronic devices which can form or obtain the image information and which can be electrically connected to the image forming apparatus. Examples of the external equipment include a computer, a digital camera, a television, a video recorder, a DVD recorder, an HDVD, a Blu-ray disc recorder, a facsimile machine, and a mobile device. The computing portion takes out the various data (such as an image formation order, the detected result, and the image information) written in the memory portion and the programs for various means, and then makes various determinations. The control portion sends to a relevant device a control signal in accordance the result determined by the computing portion, thus performing control on operations. The control portion and the computing portion include a processing circuit which is achieved by a microcomputer, a microprocessor, etc. having a central processing unit. The control unit contains a main power source as well as the above-stated processing circuit. The power source supplies electricity to not only the control unit but also respective devices provided inside the image forming apparatus.

Use of the image forming apparatus of the invention can form an image in a stable manner over a long period of time.

EXAMPLES

The invention is specifically described below by referring to Examples and Comparative Examples, but the invention is not limited to those Examples as far as not exceeding the gist of the invention.

[Synthesis of Non-Crystalline Polyester Resin]

(Non-Crystalline Polyester Resin a1)

In an autoclave equipped with a thermometer and a stirring machine, 137 parts by weight of dimethyl terephthalate, 55 parts by weight of dimethyl isophthalate, 68 parts by weight of ethylene glycol, 175 parts by weight of ethylene oxide adduct (average molecular weight 350) of bisphenol A, and 0.1 part by weight of tetrabutoxytitanate as a catalyst were charged, and the resulting mixture was heated to 150 to 220° C. for 180 minutes to conduct ester exchange reaction. The temperature was elevated to 240° C. Pressure of the reaction system was gradually reduced and reached 10 mmHg (1,333 Pa) after 30 minutes. The reaction was continued for 70 minutes. The inside of the autoclave was substituted with nitrogen gas, and atmospheric pressure was formed. The temperature was maintained at 200° C., 2 parts by weight of trimellitic anhydride were added, and reaction was conducted for 70 minutes. Thus, a non-crystalline polyester resin a1 was obtained. An acid component of the non-crystalline polyester resin a1 is dimethyl terephthalate, dimethyl isophthalate and trimellitic anhydride. Therefore, the non-crystalline polyester resin a1 contains a carboxyl group, and does not contain a sulfo group. As a result, of measurement of an acid, number of the non-crystalline polyester resin a1 obtained, the acid number was 2.3 mgKOH/g.

(Non-Crystalline Polyester Resin a2)

In an autoclave equipped with a thermometer and a stirring machine, 38 parts by weight of 1,5-naphthalene dicarboxylic acid methyl ester, 96 parts by weight of dimethyl terephthalate, 58 parts by weight of dimethyl isophthalate, 136 parts by weight of ethylene glycol, and 0.1 part by weight of tetrabutoxytitanate as a catalyst were charged, and the resulting mixture was heated to 150 to 220° C. for 180 minutes to conduct ester exchange reaction. The temperature was elevated to 240° C. Pressure of the reaction system was gradually reduced and reached 10 mmHg (1,333 Pa) after 30 minutes. The reaction was continued for 70 minutes. The inside of the autoclave was substituted with nitrogen gas, and atmospheric pressure was formed. The temperature was maintained at 200° C., 10 parts by weight of trimellitic anhydride were added, and reaction was conducted for 70 minutes. Thus, non-crystalline polyester resin a2 was obtained. An acid component of the non-crystalline polyester resin a2 is 1,5-naphthalene dicarboxylic acid methyl ester, dimethyl terephthalate, dimethyl isophthalate and trimellitic anhydride. Therefore, the non-crystalline polyester resin a2 contains a carboxyl group, and does not contain a sulfo group. As a result of measurement of an acid number of the non-crystalline polyester resin a2 obtained, the acid number was 14 mgKOH/g.

(Non-Crystalline Polyester Resin a3)

In an autoclave equipped with a thermometer and a stirring machine, 112 parts by weight of dimethyl terephthalate, 16 parts by weight of dimethyl isophthalate, 6 parts by weight of 5 sodium sulfodimethyl isophthalate, 96 parts by weight of ethylene glycol, 50 parts by weight of propylene glycol, and 0.1 part by weight of tetrabutoxytitanate were charged, and the resulting mixture was heated to 180 to 230° C. for 120 minutes to conduct ester exchange reaction. The temperature of the reaction system was elevated to 250° C., the pressure of the system was 1 to 10 mmHg (133.3 to 1,333 Pa), and the reaction was continued for 60 minutes. As a result, a non-crystalline polyester resin a3 was obtained. An acid component of the non-crystalline polyester resin a3 is dimethyl terephthalate, dimethyl isophthalate and 5 sodium sulfodimethylisophthalate. Therefore, the non-crystalline polyester resin a3 contains both a carboxyl group and a sulfo group. As a result of measurement of an acid number of the non-crystalline polyester resin a3 obtained, the acid number was 0.1 mgKOH/g.

Glass transition temperature and number average molecular weight of the non-crystalline polyester resins 1*a* to 3*a* obtained are shown in Table 1. The glass transition temperature was obtained by the measurement with DSC (differential scanning calorimetry), and the number average molecular weight was obtained by the measurement with GPC (gel permeation chromatography).

TABLE 1

| | Glass transition temperature (° C.) | Number average molecular weight |
|---|---|---|
| Non-crystalline polyester resin a1 | 64 | 3800 |
| Non-crystalline polyester resin a2 | 65 | 3500 |
| Non-crystalline polyester resin a3 | 58 | 3100 |

[Preparation of Non-Crystalline Polyester Resin Particle Aqueous Dispersion]

(Non-Crystalline Polyester Resin Particle Aqueous Dispersion A1)

Into a 10 liters four-necked separable flask equipped with a thermometer, a condenser and stirring blades, 100 parts by weight of the non-crystalline polyester resin a1, 48 parts by weight of butanol, 12 parts by weight of methyl ethyl ketone and 20 parts by weight of isopropanol were introduced, and stirred at 70° C. to dissolve them. 1 part by weight of 1N ammonia aqueous solution was added so as to be equivalent to an acid number of the non-crystalline polyester resin a1. The temperature was held at 70° C., and the stirring was conducted for 30 minutes. To the mixture while stirring, 300 parts by weight of water of 70° C. were added. Thus, an aqueous dispersion of the non-crystalline polyester resin a1 was obtained. The aqueous dispersion obtained was placed in a distillation flask, distilled until reaching the traction temperature of 100° C., followed by cooling. The solid content was adjusted with deionized water. Thus, a non-crystalline polyester resin particle aqueous dispersion A1 having a solid content concentration of 30% from which a solvent had been finally removed was obtained. Dispersed particles in the non-crystalline polyester resin particle aqueous dispersion A1 had an average particle size of 0.095 μm. The average particle size of the dispersed particles was measured with Microtrac UPA-ST150 (manufactured by NIKKISO CO., LTD.)

(Non-Crystalline Polyester Resin Particle Aqueous Dispersion A2)

Into a 10 liters four-necked separable flask equipped with a thermometer, 34 parts by weight of the non-crystalline polyester resin a2 and 10 parts by weight of butanol were introduced, a condenser and stirring blades, and stirred at 90° C. to dissolve them. The resulting mixture was cooled to 80° C. Then, 1.5 parts by weight of 1N ammonia aqueous solution was added so as to be equivalent no an acid number of the non-crystalline polyester resin a2. The temperature was held at 80° C., and the stirring was conducted for 30 minutes. To the mixture while stirring, 56 parts by weight of water of 80° C. were added. Thus, an aqueous dispersion of the non-crystalline polyester resin a2 was obtained. In a distillation flask, 1,000 parts by weight of the aqueous dispersion obtained was placed, distilled until reaching the fraction temperature of 100° C., followed by cooling. Thus, a non-crystalline polyester resin particle aqueous dispersion A2 having a solid content concentration of 33% from which a solvent had been finally removed was obtained. Dispersed particles in the non-crystalline polyester resin particle aqueous dispersion A2 had an average particle size of 0.05 μm.

(Non-Crystalline Polyester Resin Particle Aqueous Dispersion A3)

A non-crystalline polyester resin particle aqueous dispersion A3 was obtained in the same manner as in the preparation of the non-crystalline polyester resin particle aqueous dispersion A1, except for using the non-crystalline polyester resin a3. Dispersed particles in the non-crystalline polyester resin particle aqueous dispersion A3 had an average particle size of 0.2 μm.

(Non-Crystalline Polyester Resin Particle Aqueous Dispersion A4)

A non-crystalline polyester resin particle aqueous dispersion A4 was obtained in the same manner as in the preparation of the non-crystalline polyester resin particle aqueous dispersion A1, except for using the non-crystalline polyester resin a1 and changing the stirring conditions. Dispersed particles in the non-crystalline polyester resin particle aqueous dispersion A4 had an average particle size of 0.32 μm.

[Synthesis of Crystalline Polyester Resin]

(Synthesis of Crystalline Polyester Resin b1)

In a reactor equipped with a stirring machine, a thermometer, a heater, a cooling device and a condenser for distillation, 980 parts by weight of terephthalic acid, 590 parts by weight of adipic acid, 770 parts by weight of ethylene glycol, 680 parts by weight of 1,4-butanediol, 3 parts by weight of IRGANOX 1330 (manufactured by Ciba-Geigy) and 1 part by weight of tetrabutyl titanate were charged, and esterification reaction was conducted over 4 hours while elevating the temperature to 230° C. After completion of the esterification reaction, 100 parts by weight of a compound of the chemical formula (1) wherein n=14 (PTMG 1000, manufactured by Mitsubishi Chemical Corporation) were added to the reactor, and the pressure in the system was reduced to 10 mmHg (1,333 Pa) over 60 minutes while elevating the temperature to 240° C. The pressure was further reduced to the vacuum of 1 mmHg (133.3 Pa) or less, and polycondensation reaction was conducted at 240° C. for 60 minutes. Nitrogen was flown in the system to destroy the vacuum, thereby completing the polycondensation reaction. The system was cooled until the inner temperature reaches 220° C., while filling the system with nitrogen. After cooling, 90 parts by weight of ethylene glycol bisanhydrotrimellitate were introduced, the system was again filled with nitrogen, and acid addition reaction was conducted at 220° C. for 30 minutes. After completion of the reaction, a polyester resin was taken out of the reactor, and cooled. Thus, a crystalline polyester resin b1 was obtained. An acid component of the crystalline polyester resin b1 is terephthalic acid, adipic acid and ethylene glycol bisanhydrotrimellitate, and an alcohol component is ethylene glycol, 1,4-butanediol and PTMG 1000. Therefore, the crystalline polyester resin b1 contains a carboxyl group, and contains the compound of the chemical formula (1) and 1,4-butanediol as an alcohol component. The crystalline polyester resin b1 had a number average molecular weight of 21,000 and a melting point (Tm) of 110° C.

(Synthesis of Crystalline Polyester Resin b2)

Charged were 963 parts by weight of terephthalic acid, 146 parts by weight of adipic acid, 627 parts by weight of sebacic acid, 30 parts by weight of 5 sulfonite sodium isophthalate, 243 parts by weight of ethylene glycol, 495 parts by weight of 1,4-butanediol, 3 parts by weight of IRGANOX 1330 (manufactured by Ciba-Geigy) and 1 part by weight of tetrabutyl titanate, and esterification reaction was conducted over 4 hours while elevating the temperature to 230° C. After completion of the esterification reaction, 500 parts by weight of a compound of the chemical formula (1) wherein n=14 (PTMG 1000, manufactured by Mitsubishi Chemical Corporation) were added to the reactor, and the pressure in the system was reduced to 10 mmHg (1,333 Pa) over 60 minutes while elevating the temperature to 240° C. The pressure was further reduced to the vacuum of 1 mmHg (133.3 Pa) or less, and polycondensation reaction was conducted at 240° C. for 60 minutes. Nitrogen was flown in the system to destroy the vacuum, thereby completing the polycondensation reaction. The system was cooled until the inner temperature reaches 220° C., while filling the system with nitrogen. After cooling, 39 parts by weight of trimellitic acid and 45 parts by weight of ethylene glycol bisanhydrotrimellitate were introduced, the system was again filled with nitrogen, and acid addition reaction was conducted at 220° C. for 30 minutes. After completion of the reaction, a polyester resin was taken out of the reactor, and cooled. Thus, a crystalline polyester resin b2 was obtained. An acid component of the crystalline polyester resin b2 is terephthalic acid, adipic acid, sebacic acid, 5 sulfonite sodium isophthalate, trimellitic acid and ethylene glycol bisanhydrotrimellitate, and an alcohol component is ethylene glycol, 1,4-butanediol and PTMG 1000. Therefore, the crystalline polyester resin b2 contains a carboxyl group and a sulfo group, and contains the compound of the chemical formula (1) and 1,4-butanediol as an alcohol component. The crystalline polyester resin b2 had a number average molecular weight of 25,000 and Tm of 105° C.

(Synthesis of Crystalline Polyester Resin b3)

Crystalline polyester resin b3 was synthesized in the same manner as in the synthesis of the crystalline polyester resin b1, except that PTMG 1000 which is the compound of the chemical formula (1) was not added. Therefore, the crystalline polyester resin b3 contains a carboxyl group, and contains 1,4-butanediol as an alcohol component. The crystalline polyester resin b3 had a number average molecular weight of 13,000 and Tm of 105° C.

(Synthesis of Crystalline Polyester Resin b4)

Charged were 2,020 parts by weight of sebacic acid, 620 parts by weight of ethylene glycol, 3 parts by weight of IRGANOX 1330 (manufactured by Ciba-Geigy) and 1 part by weight of tetrabutyl titanate, and esterification reaction was conducted over 4 hours while elevating the temperature to 230° C. Then, 45 parts by weight of ethylene glycol bisanhydrotrimellitate were introduced, the system was again filled with nitrogen, and acid addition reaction was conducted at 220° C. for 30 minutes. After completion of the reaction, a polyester resin was taken out of the reactor, and cooled. Thus, a crystalline polyester resin b4 was obtained. An acid component of the crystalline polyester resin b4 is sebacic acid and ethylene glycol bisanhydrotrimellitate, and an alcohol component is ethylene glycol. Therefore, the crystalline polyester-resin b4 contains a carboxyl group. The crystalline polyester resin b4 had a number average molecular weight of 15,000 and Tm of 65° C.

(Synthesis of Crystalline Polyester Resin b5)

Crystalline polyester resin b5 was synthesized in the same manner as in the synthesis of the crystalline polyester resin b1, except that ethylene glycol was used in place of 1,4-butanediol. Therefore, the crystalline polyester resin b5 contains a carboxyl group, and contains the compound of the chemical formula (1) as an alcohol component. The crystalline polyester resin b5 had a number average molecular weight of 17,000 and Tm of 75° C.

[Preparation of Polyester Resin Particle Aqueous Dispersion]

(Crystalline Polyester Resin Particle Aqueous Dispersions B1 to B5 and B7)

Into a three-necked separable flask equipped with a thermometer, a condenser and stirring blades, 270 parts by weight of the crystalline polyester resin b1, 80 parts by weight of methyl ethyl ketone and 60 parts by weight of isopropyl alcohol were introduced, and dissolved at 70° C. Then, 5 parts by weight of ammonia as a base were added, and 630 parts by weight of ion-exchanged water of 70° C. were then added to perform water dispersion. The resulting dispersion was distilled in a distillation flask until the fraction temperature reaches 100° C. After cooling, water was added. Thus, a crystalline polyester resin particle aqueous dispersion B1 having a solid content concentration of 30% was obtained. Dispersed particles present in the crystalline polyester resin particle aqueous dispersion B1 had an average particle size of 0.1 μm. Aqueous dispersions B2 to B5 of the crystalline polyester resins b2 to b5, respectively, were prepared in the same manner as above. The average particle sizes of the dispersed particles were 0.116 μm, 0.110 μm, 0.120 μm and 0.240 μm, respectively.

Crystalline polyester resin particle aqueous dispersion B7 was prepared in the same manner as in the preparation of the crystalline polyester resin particle aqueous dispersions B1, except that only the stirring conditions were changed. The dispersed particles present therein had an average particle size of 0.31 μm.

(Crystalline Polyester Resin Particle Aqueous Dispersion B6)

First, 10 parts by weight of a surfactant (NEOGEN SF) were added to 100 parts by weight of the crystalline polyester resin b1, and 300 parts by weight of water were added to the mixture. The resulting mixture was introduced into a homogenizer (PT3000, manufactured by Polytron Corporation), and dispersion was conducted by stirring for 20 minutes while heating to 60° C. Thus, a crystalline polyester resin particle aqueous dispersion B6 was obtained. Dispersed particles present therein had an average particle size of 0.15 μm.

(Polyester Resin Particle Aqueous Dispersion B8)

First, 130 parts by weight of the crystalline polyester resin b1 and 130 parts by weight of the non-crystalline polyester resin a1 were dissolved in a mixed solvent of 180 parts by weight of methyl ethyl ketone and 60 parts by weight of isopropyl alcohol at 70° C. Then, 5 parts by weight of ammonia as a base were added, and 630 parts by weight of ion-exchanged water of 70° C. were added, followed by performing water dispersion. The resulting dispersion was distilled in a distillation flask until the fraction temperature reaches 100° C. After cooling, water was added. Thus, a polyester resin particle aqueous dispersion B8 having a solid content concentration of 30% was obtained. Dispersed particles present in the polyester resin particle aqueous dispersion B8 obtained had an average particle size of 0.18 μm.

(Crystalline Polyester Resin Particle Aqueous Dispersion B9)

First, 100 parts the crystalline polyester resin b1 were added to 630 parts by weight of ion-exchanged water containing 5 parts by weight of ammonia, and the resulting mixture was emulsified with a high pressure homogenizer while heating to 120° C. Thus, a crystalline polyester resin particle aqueous dispersion B9 was obtained. Dispersed particles present in the aqueous dispersion had an average particle size of 0.4 μm.

Storage stability test of those polyester resin particle aqueous dispersions was conducted as follows. The polyester resin particle aqueous dispersions (B1 to B9) were stored at 50° C. for 3 days. When change of 40% or more appeared in the average particle size, or when precipitates were generated, the case was indicated as "Poor". The results obtained are shown in Table 2.

TABLE 2

| | B1 | B2 | B3 | B4 | B5 | B6 | B7 | B8 | B9 |
|---|---|---|---|---|---|---|---|---|---|
| Storage stability test | Good | Good | Poor | Poof | Poof | Good | Poor | Good | Poor |
| Particle size | 0.11 | 0.12 | Precipitates were generated. | Precipitates were generated. | Precipitates were generated. | 0.16 | Precipitates were generated. | 0.18 | Precipitates were generated. |

[Preparation of Colorant Particle Aqueous Dispersion]

(Cyan Colorant Particle Aqueous Dispersion)

Into a homogenizer, 50 parts by weight of a cyan colorant (Eupolen Blue 69-1501, manufactured by BASF), 5 parts by weight of an anionic surfactant (NEOGEN R, manufactured by DAI-ICHI KOGYO SEIYAKU CO., LTD.) and 223 parts by weight of ion-exchanged water were introduced, and stirred at room temperature for 20 minutes to disperse the colorant. The colorant was further dispersed with an ultrasonic homogenizer (manufactured by NIHONSEIKI KAISHA LTD.) for 20 minutes. Thus, a cyan colorant particle aqueous dispersion containing dispersed particles having an average particle size of 0.2 μm was obtained. The average particle size of dispersed particles in the cyan colorant particle aqueous dispersion and other colorant particle aqueous dispersions described hereinafter was measured with Microtrac UPA-ST150 (manufactured by NIKKISO CO., LTD.)

(Magenta Colorant Particle Aqueous Dispersion)

Into a homogenizer (PT3000, manufactured by Polytron), 50 parts by weight of a magenta colorant (Eupolen Red 47-9001), 5 parts by weight of an anionic surfactant (NEOGEN R, manufactured by DAI-ICHI KOGYO SEIYAKU CO., LTD.) and 223 parts by weight of ion-exchanged water were introduced, and stirred at room temperature for 20 minutes to disperse the colorant. The colorant was further dispersed with an ultrasonic homogenizer for 20 minutes. Thus, a magenta colorant particle aqueous dispersion containing dispersed particles having an average particle size of 0.2 μm was obtained.

(Yellow Colorant Particle Aqueous Dispersion)

Into a homogenizer (PT3000, manufactured by Polytron), 50 parts by weight of a yellow colorant (Eupolen Yellow 09-6101, manufactured by BASF), 5 parts by weight of an anionic surfactant (NEOGEN R, manufactured by DAI-ICHI KOGYO SEIYAKU CO., LTD.) and 223 parts by weight of ion-exchanged water were introduced, and stirred at room temperature for 20 minutes to disperse the colorant. The colorant was further dispersed with an ultrasonic homogenizer for 20 minutes. Thus, a yellow colorant particle aqueous dispersion containing dispersed particles having an average particle size of 0.1 μm was obtained.

(Black Colorant Particle Aqueous Dispersion)

Into a homogenizer (PT3000, manufactured by Polytron), 50 parts by weight of carbon black (MORGAL L, manufactured by Cabot Corporation), 5 parts by weight of a nonionic surfactant (NONIPOL 400, manufactured by Sanyo Chemical Industries, Ltd.) and 223 parts by weight of ion-exchanged water were introduced, and stirred at room temperature for 20 minutes to disperse the colorant. Thus, a black colorant particle aqueous dispersion containing dispersed particles having an average particle size of 0.15 μm was obtained.

[Preparation of Wax Particle Aqueous Dispersion]

Into a stainless steel, beaker with a jacket, 50 parts by weight of paraffin wax (HNP10, manufactured by Nippon Seiro Co., Ltd., melting point: 72° C.), 5 parts by weight of an anionic surfactant (NEOGEN R, manufactured by DAI-ICHI KOGYO SEIYAKU CO., LTD.) and 161 parts by weight of ion-exchanged water were introduced. The paraffin wax was dispersed with a homogenizer (PT3000, manufactured by Polytron) for 30 minutes while heating to 95° C. The resulting mixture was transferred into a pressure-discharge homogenizer (manufactured by NIHONSEIKI KAISHA LTD.), and dispersion treatment was conducted at 90° C. for 20 minutes. Thus, a wax particle aqueous dispersion containing dispersed particles having an average particle size of 0.4 μm was obtained. The average particle size of dispersed particles in the wax colorant particle aqueous dispersion was measured with Microtrac UPA-ST150 (manufactured by NIKKISO CO., LTD.)

Example 1

(Liquid Mixture Preparation Step)

The cyan colorant particle aqueous dispersion, the crystalline polyester resin particle aqueous dispersion B1 and the wax particle aqueous dispersion were mixed in the solid content concentrations (wt %) shown in Table 3. Thus, a liquid mixture was obtained.

[Aggregate Formation Step]

Next, 120 parts by weight of 0.1 wt % magnesium sulfate aqueous solution were gradually added to 100 parts by weight of the liquid mixture obtained while stirring the liquid mixture at 1,500 rpm using a propeller-type stirring machine, and the resulting liquid mixture was stirred for 1 hour. As a result, aggregates were formed in an aqueous medium. The mixture was heated to 75° C., and particle shape was controlled until the particle shape changes from a botryoidal shape to a slightly round shape by observing with an optical microscope. The temperature was decreased to room temperature, the non-crystalline polyester resin particle aqueous dispersion A1 was added, and 21 parts by weight of 0.1 wt % magnesium sulfate aqueous solution was gradually added dropwise. The resulting liquid mixture was stirred for 1 hour. As a result, aggregates as a toner were formed in the aqueous medium. A particle size of the aggregates was adjusted by adjusting the amount of a polyvalent metal salt added.

[Particle Formation Step]

The aqueous medium containing aggregates which passed though the aggregate formation step was heated to 75° C., and stirring was continued for 30 minutes. Stirring was further conducted at 94° C. for 20 minutes to uniformize particle size and shape of the aggregates. Thus, the shape of aggregates was adjusted by adjusting the temperature, and time of the particle formation step.

(Washing Step)

A supernatant of the aqueous medium containing aggregates was removed, and the aggregates were washed with pure water three times (the supernatant was exchanged three times). The aggregates were washed with HCl aqueous solution adjusted to pH 2, washed with pure water three times, filtered off and dried with a vacuum dryer. Thus, a toner was prepared. The pure water used in washing was water of 0.5 μS/cm prepared form tap water using an ultrapure water production system (Ultra Pure Water System CPW-102, manufactured by ADVANTEC). The pH and conductivity of water were measured using Lacom tester (EC-PHCON10, manufactured by Iuchi Seieido). 0.7 part by weight of silica particles having an average primary particle size of 20 nm treated with a silane coupling agent was mixed (external addition) with 100 parts by weight of the toner obtained by the above method. Thus, a toner of Example 1 was obtained.

Examples 2 to 6 and Comparative Examples 1 to 7

Toners were produced in the same manner as in Example 1, except for forming the aggregates using the colorant particle aqueous dispersion, the wax particle aqueous dispersion, the crystalline polyester resin particle aqueous dispersion and the non-crystalline polyester resin particle aqueous dispersion in the solid content concentrations (wt %) shown in Table 3. Thus, toners of Examples 2 to 6 and Comparative Examples 1 to 7 were obtained. Regarding Example 5, a small amount of the non-crystalline polyester resin particle aqueous dispersion A2 was added in the liquid mixture preparation step, and the non-crystalline polyester resin particle aqueous dispersion A1 was added in the aggregate formation step. Furthermore, regarding Comparative Example 4, a non-crystalline polyester resin particle aqueous dispersion is not added in the aggregate formation step.

TABLE 3

| | | Solid content concentration (wt %) | | | | | | | | | | | | |
|---|---|---|---|---|---|---|---|---|---|---|---|---|---|---|
| | | Ex. 1 | Ex. 2 | Ex. 3 | Ex. 4 | Ex. 5 | Ex. 6 | Comp. Ex. 1 | Comp. Ex. 2 | Comp. Ex. 3 | Comp. Ex. 4 | Comp. Ex. 5 | Comp. Ex. 6 | Comp. Ex. 7 |
| Polyester resin particle aqueous dispersion | A1 | 30 | — | 25 | 30 | 28 | — | — | 30 | — | — | 3 5 | 10 | — |
| | A2 | — | 35 | — | — | 2 | — | 30 | — | — | — | — | — | — |
| | A3 | — | — | — | — | — | — | — | — | 30 | — | — | — | — |
| | A4 | — | — | — | — | — | 30 | — | — | — | — | — | — | — |
| | B1 | 60 | 55 | 65 | — | 60 | — | — | — | — | — | — | — | 30 |
| | B2 | — | — | — | — | — | — | 60 | — | 60 | 90 | — | — | — |
| | B5 | — | — | — | 60 | — | — | — | — | — | — | — | — | — |
| | B6 | — | — | — | — | — | — | — | 60 | — | — | 60 | — | — |
| | B7 | — | — | — | — | — | 60 | — | — | — | — | — | — | — |
| | B8 | — | — | — | — | — | — | — | — | — | — | — | 80 | — |
| | B9 | — | — | — | — | — | — | — | — | — | — | — | — | 60 |
| Colorant | Cyan | 5 | — | — | — | 5 | — | 5 | — | — | — | 5 | — | — |
| | Magenta | — | 5 | — | — | — | 5 | — | 5 | — | — | — | 5 | — |
| | Yellow | — | — | 5 | — | — | — | — | — | 5 | — | — | — | 5 |
| | Black | — | — | — | 5 | — | — | — | — | — | 5 | — | — | — |
| Wax | | 5 | 5 | 5 | 5 | 5 | 5 | 5 | 5 | 5 | 5 | — | 5 | 5 |

[Evaluation Method]

Regarding the toners of Examples 1 to 6 and Comparative Examples 1 to 7, each evaluation of volume average particle size, coefficient of variation, average degree of circularity, image density, mottle, environmental evaluation, fixability and charge amount, and a comprehensive evaluation of those were performed according to the evaluation methods described below. The results obtained are shown in Table 4. In Table 4, the symbol "Good" means that the evaluation is very excellent in each item.

(Volume Average Particle Size and Coefficient of Evaluation)

Volume average particle size and coefficient of evaluation of toner particles were measured using Coulter Multisizer III (manufactured by Coulter), and evaluated by the following standards based on the coefficient of variation. The number of particles measured was 50,000 counts, and an aperture diameter was 100 μm. The unit of the volume average particle size in Table 4 is μm. The coefficient of variation of toner was calculated by the following formula based on the volume average particle size and its standard deviation.

Coefficient of variation CV (%)=(Standard deviation/volume average particle size)×100

Good: Coefficient of variation is 25% or less.

Not Bad: Coefficient of variation is 25% to 30%.

Poor: Coefficient of variation is 30% or more.

(Average Degree of Circularity)

Average degree of circularity of toner particles was measured using a flow-type particle image analyzer (FPIA-2000, manufactured by Toa Medical Electronics Co., Ltd., now Sysmex). The average degree of circularity is defined by the following formula in the projection image of particle detected by the flow-type particle image analyzer, and is a value of 1 or less.

Degree of circularity=(Perimeter of circle having the same area of projection image)/(perimeter of projection image)

(Image Density)

Optical density of an evaluation image was measured using a spectrophotometric densitometer (X-Rite 938, manufactured by Nippon Lithograph, Inc.), and the image density was evaluated by the following standards based on the optical density. The evaluation image was prepared as follows. Toner particles as a developer were used in a device obtained by modifying a developing device of a digital full-color copying machine (AR-C150, manufactured by Sharp Corporation) to a device for non-magnetic one-component development. Printing was conducted on a full-color exclusive (PP106A4C, manufactured by Sharp Corporation) using the toner particles by adjusting such that the amount of toner particles adhered was 0.6 mg/cm$^2$, and the print was fixed using an external fixing machine.

Good: Optical density is 1.2 or more.

Poor: Optical density is less than 1.2.

(Mottle)

Mottle was evaluated as follows. Toner particles as a developer were used in a device obtained by modifying a developing device of a digital full-color copying machine (AR-C150, manufactured by Sharp Corporation). Printing was conducted on each paper using the toner particles by adjusting such that the amount of toner particles adhered was 0.6 mg/cm$^2$, and the print was fixed using an external fixing machine. The mottle was visually evaluated. The speed was 200 mm/sec.

a: No mottle, and good b: Mottle is slightly visible, but is not strong.

c: Mottle is present, but there is no practical problem.

d: Mottle is visible.

e: Mottle is strong.

Good: a or b

Not Bad: c

Poor: d or e (Environmental Evaluation)

70 g of a toner was rotated at the same number of revolution as above using the digital full-color coping machine under the respective environments ((a) temperature: 5° C. and humidity: 10%, (b) temperature: 35° C. and humidity: 80%), and charge amount of the toner in this case was measured. The environmental evaluation was evaluated by the following standards based on a relative ratio calculated by the following formula.

Relative ratio (%)=(Charge amount in the case of (*b*)/charge amount in the case of (*a*))×100

Good: Relative ratio is 65% or more.

Not Bad: Relative ratio is 65% to 50%.

Poor: Relative ratio is 50% or less.

(Fixability)

Fixability was evaluated as follows. Toner particles as a developer were used in a device obtained by modifying a developing device of a digital full-color copying machine (AR-C150, manufactured by Sharp Corporation). Printing was conducted on each paper using the toner particles by adjusting such that the amount of toner particles adhered was 1.2 mg/cm$^2$, and the print was fixed using an external fixing machine. The mottle was visually evaluated. Generation of offset when fixed at a fixing speed of 200 mm/sec at a temperature of 150° C. was visually confirmed.

Good: Offset is not observed.

Not Bad: Offset is slightly observed.

Poor: Offset is strong.

(Charge Amount)

Charge amount of toner particles was measured using a charge amount measuring device (trade name: 210HS-2A, manufactured by Trek Japan KK) and evaluated by the following standards. Specifically, a developer in a developing layer in the digital full-color copying machine is placed in a metal-made vessel, and the vessel was sucked at a suction pressure of 250 mmHg (33,325 Pa) with a suction apparatus. Charge amount of toner was obtained from weight of the developer and potential difference between and capacitor polar plates connected to the vessel.

Good: Charge amount is 25 μC/g or more.

Poor: Charge amount is less than 25 μC/g.

(Comprehensive Evaluation)

The comprehensive evaluation is as follows. In each evaluation, the case that "Poor" and "Not Bad" are not present at all is indicated "Good", the case that "Poor" is not present and at least one "Not Bad" is present is indicated "Not Bad", and the case that at least one "Poor" is present is indicated "Poor".

TABLE 4

| | Volume average particle size | Coefficient of variation | | Average degree of circularity | Image density | | Mottle | | Environmental evaluation | | Fixability | Charge amount | | Comprehensive evaluation |
|---|---|---|---|---|---|---|---|---|---|---|---|---|---|---|
| Ex. 1 | 5.8 | 22 | Good | 0.96 | 1.3 | Good | a | Good | 70 | Good | Good | 28 | Good | Good |
| Ex. 2 | 5.6 | 22 | Good | 0.97 | 1.3 | Good | a | Good | 67 | Good | Good | 31 | Good | Good |
| Ex. 3 | 6.5 | 24 | Good | 0.97 | 1.3 | Good | c | Not Bad | 68 | Good | Good | 27 | Good | Not Bad |
| Ex. 4 | 6.9 | 28 | Not Bad | 0.97 | 1.3 | Good | c | Not Bad | 66 | Good | Not Bad | 29 | Good | Not Bad |
| Ex. 5 | 6.2 | 23 | Good | 0.96 | 1.2 | Good | c | Not Bad | 55 | Not Bad | Good | 28 | Good | Not Bad |
| Ex. 6 | 7.1 | 26 | Not Bad | 0.96 | 1.3 | Good | c | Not Bad | 60 | Not Bad | Good | 29 | Good | Not Bad |

TABLE 4-continued

| | Volume average particle size | Coefficient of variation | Average degree of circularity | Image density | Mottle | Environmental evaluation | Fixability | Charge amount | Comprehensive evaluation |
|---|---|---|---|---|---|---|---|---|---|
| Comp. Ex. 1 | 6.2 | 21 Good | 0.96 | 1.2 Good | a Good | 45 Poor | Good | 25 Good | Poor |
| Comp. Ex. 2 | 6.0 | 23 Good | 0.97 | 1.4 Good | a Good | 40 Poor | Good | 29 Good | Poor |
| Comp. Ex. 3 | 7.8 | 21 Good | 0.95 | 1.3 Good | d Poor | 40 Poor | Good | 26 Good | Poor |
| Comp. Ex. 4 | 6.0 | 22 Good | 0.97 | 1.3 Good | b Good | 41 Poor | Poor | 15 Poor | Poor |
| Comp. Ex. 5 | 6.0 | 22 Good | 0.97 | 1.2 Good | c Not Bad | 40 Poor | Poor | 27 Good | Poor |
| Comp. Ex. 6 | 6.2 | 22 Good | 0.97 | 1.3 Good | c Not Bad | 60 Not Bad | Poor | 27 Good | Poor |
| Comp. Ex. 7 | 7.2 | 35 Poor | 0.97 | 1.3 Good | d Poor | 65 Good | Good | 25 Good | Poor |

(As to Table 2)

As is seen from Table 2, the crystalline polyester resin particle aqueous dispersions B3 and B4 that do not contain a polyester resin containing the compound of the chemical formula (1) as an alcohol component have poor dispersion stability. The crystalline polyester resin particle aqueous dispersion B5 that does not contain a polyester resin containing 1,4-butanediol as an alcohol component also has poor dispersion stability. The crystalline polyester resin particle aqueous dispersions B7 and B9 in which dispersed particles in the polyester resin particle aqueous dispersion have an average particle size of 0.3 μm or more also have low dispersion stability.

(As to Table 4)

It is seen from, the comparison between Example 2 and Comparative Example 1 that environmental characteristics are deteriorated in Comparative Example 1. The reason for this is that the toner of Comparative Example 1 contains a sulfo group. Examples 2 and 3 that do not contain a sulfo group, similar to Example 1 have good environmental characteristics. It is understood that a crystalline polyester resin having less sulfo group is preferably used to produce a toner having good environmental characteristics.

It is seen from the comparison between Example 1 and Example 5 that environmental characteristics are deteriorated in Example 5. The reason for this is that because the non-crystalline polyester resin particle aqueous dispersion was mixed in the liquid mixture preparation step of Example 5, colorant particles were distributed in the vicinity of the surface, and as a result, the colorant particles adversely affected charge characteristics. It is seen from the comparison between Comparative Example 1 and Comparative Example 4 that fixability is deteriorated in Comparative Example 4. The reason for this is that because the non-crystalline polyester resin particle aqueous dispersion was not added in Comparative Example 4, softening point of a toner is decreased, and as a result, high temperature offset was generated. In view of the above, it is understood that the non-crystalline polyester resin particle aqueous dispersion is preferably added in the aggregate formation step in order to obtain a toner having good environmental characteristics and high fixability.

It is seen from the comparison between Example 1 and Example 4 that fixability is deteriorated in Example 4. The reason for this is that because the crystalline polyester resin containing 1,4-butanediol as an alcohol component was not contained in Example 4, crystallizability of the toner produced was decreased. It is understood that the crystalline polyester resin particle aqueous dispersion containing a crystalline polyester resin containing 1,4-butanediol as an alcohol component is preferably used to produce a toner having high fixability.

It is seen from the comparison between Example 1 and Comparative Example 6 that fixability is deteriorated in Comparative Example 6. The reason for this is that because the aqueous dispersion was prepared by conducting phase inversion emulsification by mixing the crystalline polyester resin and the non-crystalline polyester resin in Comparative Example 6, crystallizability of the toner produced was decreased. It is understood that the crystalline polyester resin particle aqueous dispersion obtained by dispersing only the crystalline polyester resin in an aqueous medium by phase inversion emulsification is preferably used to produce a toner having high fixability.

It is seen from the comparison between Example 1 and Comparative Example 2 that environmental characteristics are deteriorated in Comparative Example 2. The reason for this is that because the crystalline polyester particle aqueous dispersion obtained by dispersing the crystalline polyester resin using a surfactant, the surfactant was incorporated into a toner. It is understood that the crystalline polyester resin particle aqueous dispersion obtained by dispersing the crystalline polyester resin in an aqueous medium by phase inversion emulsification without using a surfactant is preferably used to produce a toner having good environmental characteristics.

It is seen from the comparison between Example 1 and Comparative Example 7 that a particle size distribution is broadened and an average particle size is increased, in Comparative Example 7. The reason for this is that because the aqueous dispersion obtained by dispersing the crystalline polyester resin in an aqueous medium by heat melting the crystalline polyester resin was used in Comparative Example 7, the crystalline polyester resin particle aqueous dispersion in which the dispersed particles in the aqueous medium have broad particle size distribution and have large average particle size was necessarily used. It is understood that the crystalline polyester resin particle aqueous dispersion obtained by dispersing the crystalline polyester resin in an aqueous medium by phase inversion emulsification without using a surfactant is preferably used to produce a toner having small particle size and small scattering.

It is seen from the comparison between Comparative Example 1 and Comparative Example 3 that environmental characteristics are deteriorated in Comparative Example 3. The reason for this is that the non-crystalline polyester resin particle aqueous dispersion containing a sulfo group was used in Comparative Example 3. It is understood that the non-crystalline polyester resin having less sulfo group is preferably used to obtain a toner having good environmental characteristics.

It is seen from the comparison between Example 1 and Example 6 that a particle size distribution is broadened and an average particle size is increased, in Example 6. The reason for this is that the crystalline polyester resin particle aqueous dispersion having a dispersed particle size larger than 0.3 μm was used in Example 6. It is understood that the crystalline polyester resin particle aqueous dispersion having a dispersed particle size of 0.3 μm or smaller is preferably used to produce a toner having small particle size and small scattering.

In view of the above, it is understood that the toner is desirably produced as follows. The aqueous dispersion obtained by dispersing the crystalline self-dispersion polyester resin having at least one carboxyl group and containing the compound of the chemical formula (1) as an alcohol component and 1,4-butanediol in an aqueous medium by phase inversion emulsification, the colorant particle aqueous dispersion and the wax particle aqueous dispersion are mixed and aggregated, the non-crystalline polyester resin particle aqueous dispersion having at least one carboxyl group is added to further perform aggregation, thereby forming aggregates, and a toner is produced from the aggregates.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for producing a toner, comprising:

a liquid mixture preparation step of mixing at least a colorant particle aqueous dispersion containing colorant particles, a wax particle aqueous dispersion containing wax particles and a crystalline self-dispersion polyester resin particle aqueous dispersion containing at least one carboxyl group as a hydrophilic group, thereby preparing a liquid mixture;

an aggregate formation step of adding a polyvalent metal salt as an aggregating agent to the liquid mixture obtained above, aggregating the colorant particles, the wax particles and the crystalline self-dispersion polyester resin particles to form aggregates, and mixing a non-crystalline polyester resin particle aqueous dispersion with the liquid mixture containing the aggregates to further perform aggregation; and a particle formation step of heating the liquid mixture after completion of the aggregate formation step to uniformize particle size and shape of the aggregates in the liquid mixture, wherein the crystalline self-dispersion polyester resin particles contain a compound represented by the following chemical formula (1) as an alcohol component:

$$H—(—O—CH_2CH_2CH_2CH_2—)—OH \quad (1)$$

wherein n is an integer of from 2 to 50, and further contain 1,4-butanediol as a secondary alcohol component.

2. The method of claim 1, wherein the crystalline polyester resin particle aqueous dispersion is prepared by phase inversion emulsification changing phase into an aqueous system after conducting swelling or dissolution with an organic solvent, without using a surfactant.

3. The method of claim 1, wherein the non-crystalline self-dispersion polyester resin particles contain a carboxyl group as a hydrophilic group.

4. The method of claim 1, wherein the crystalline self-dispersion polyester resin particles have a volume average particle size of 0.3 μm or less.

5. A toner comprising toner particles made of particulate aggregates produced by the method for producing a toner of claim 1.

6. The toner of claim 5, wherein a colorant component and a crystalline polyester resin component are present in a surface layer in small amount and is present in the inside in large amount.

7. The toner of claim 5, wherein one or more of inorganic particles having an average particle size of 0.2 μm or less is externally added to the surface of toner particles.

8. A two-component developer comprising the toner of claim 5 and a carrier.

* * * * *